US009633599B2

(12) United States Patent
Ohara et al.

(10) Patent No.: US 9,633,599 B2
(45) Date of Patent: Apr. 25, 2017

(54) PIXEL CIRCUIT, DISPLAY DEVICE INCLUDING THE SAME AND DRIVING METHOD OF THE DISPLAY DEVICE

(71) Applicant: Sharp Kabushiki Kaisha, Osaka (JP)

(72) Inventors: Masanori Ohara, Osaka (JP); Noboru Noguchi, Osaka (JP); Noritaka Kishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/417,117

(22) PCT Filed: Jul. 24, 2013

(86) PCT No.: PCT/JP2013/070000

§ 371 (c)(1),
(2) Date: Jan. 23, 2015

(87) PCT Pub. No.: WO2014/021159

PCT Pub. Date: Feb. 6, 2014

(65) Prior Publication Data

US 2015/0179101 A1 Jun. 25, 2015

(30) Foreign Application Priority Data

Jul. 31, 2012 (JP) ..... 2012-169593

(51) Int. Cl.
*G09G 3/30* (2006.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01);
(Continued)

(58) Field of Classification Search
CPC ..... G09G 3/3266; G09G 3/3233; G09G 2300/0819; G09G 2300/0842;
(Continued)

(56) References Cited

U.S. PATENT DOCUMENTS

2002/0008685 A1* 1/2002 Ban ..... G09G 3/3655 345/92
2002/0154083 A1* 10/2002 Miyazawa ..... G09G 3/3648 345/89

(Continued)

FOREIGN PATENT DOCUMENTS

CN 101211535 A 7/2008
JP 2003-271095 A 9/2003

(Continued)

OTHER PUBLICATIONS

International Search Report received for PCT Patent Application No. PCT/JP2013/070000 mailed on Sep. 10, 2013, 4 pages.

(Continued)

*Primary Examiner* — Prabodh M Dharia
(74) *Attorney, Agent, or Firm* — Morrison & Foerster LLP

(57) ABSTRACT

A pixel circuit is capable of maintaining a display quality even in cases where an input transistor has a low mobility, or where it is impossible to take a sufficient selection period for each scanning line. A pixel circuit includes an organic EL element (OLED), transistors, and a capacitor. A drive transistor has its drain terminal connected to a HIGH level power supply line, and has its source terminal connected to an anode terminal of the OLED. The first input transistor has its gate terminal connected to a scanning line Si, and is disposed between a data line Dj and the gate terminal of the drive transistor. The second input transistor has its gate terminal connected to a scanning line (Si−1) in the (i−1)th row, and is disposed between a data line and the gate
(Continued)

terminal of the drive transistor. The capacitor is disposed between the gate terminal and the source terminal of the drive transistor.

16 Claims, 16 Drawing Sheets

(52) U.S. Cl.
CPC ..... *G09G 2300/0842* (2013.01); *G09G 2300/0861* (2013.01); *G09G 2310/0262* (2013.01); *G09G 2320/043* (2013.01)

(58) Field of Classification Search
CPC ... G09G 2300/0861; G09G 2310/0262; G09G 2320/043
USPC ..... 345/76–92, 204–212, 690, 691; 315/172, 315/299, 169.3; 349/2, 46; 313/463
See application file for complete search history.

(56) References Cited

U.S. PATENT DOCUMENTS

2003/0107560 A1* 6/2003 Yumoto ..... G09G 3/30 345/204
2004/0179005 A1* 9/2004 Jo ..... G09G 3/325 345/211
2004/0189627 A1* 9/2004 Shirasaki ..... G09G 3/32 345/204
2004/0196224 A1* 10/2004 Kwon ..... G09G 3/3241 345/82
2005/0017934 A1* 1/2005 Chung ..... G09G 3/3233 345/82
2005/0083270 A1* 4/2005 Miyazawa ..... G09G 3/3233 345/76
2005/0200572 A1* 9/2005 Weng ..... G09G 3/3241 345/76
2005/0206590 A1 9/2005 Sasaki et al.
2005/0264493 A1* 12/2005 Shin ..... G09G 3/325 345/76
2005/0270257 A1* 12/2005 Shin ..... G09G 3/3275 345/76
2005/0285825 A1* 12/2005 Eom ..... G09G 3/3233 345/76
2006/0077077 A1* 4/2006 Kwon ..... G09G 3/3241 341/50
2006/0152451 A1* 7/2006 Shin ..... G09G 3/3241 345/76
2007/0052644 A1* 3/2007 Uchino ..... G09G 3/3233 345/92
2007/0118781 A1* 5/2007 Kim ..... G09G 3/3233 714/727
2008/0048955 A1* 2/2008 Yumoto ..... G09G 3/3233 345/82
2008/0158110 A1* 7/2008 Iida ..... G09G 3/3233 345/76
2008/0170011 A1* 7/2008 Kohno ..... G09G 3/3233 345/77
2009/0015571 A1* 1/2009 Kawasaki ..... G09G 3/325 345/204
2009/0033599 A1* 2/2009 Kawasaki ..... G09G 3/3233 345/76
2009/0115707 A1* 5/2009 Park ..... G09G 3/3233 345/76
2009/0153546 A1* 6/2009 Senda ..... G09G 3/3283 345/214
2010/0013746 A1* 1/2010 Seto ..... G09G 3/3233 345/76
2010/0277402 A1* 11/2010 Miyazawa ..... G09G 3/3233 345/76
2011/0018855 A1* 1/2011 Miyazawa ..... G09G 3/3233 345/211
2011/0063275 A1* 3/2011 Imamura ..... G09G 3/3233 345/211
2013/0069926 A1* 3/2013 Park ..... G09G 3/3233 345/211
2015/0138183 A1* 5/2015 Kishi ..... G09G 3/3291 345/214
2015/0199932 A1* 7/2015 Ohara ..... G09G 3/3233 345/212

FOREIGN PATENT DOCUMENTS

JP 2005-31630 A 2/2005
JP 2005-346025 A 12/2005
JP 4637070 B 2/2011

OTHER PUBLICATIONS

International Search Report received for PCT Patent Application No. PCT/JP2013/069999 mailed on Oct. 8, 2013, 4 pages.

* cited by examiner

*FIG. 19*

| Resolution | Number of Scanning Lines | 1 H-period (μs) | |
|---|---|---|---|
| | | 60Hz | 120Hz |
| HD | 720 | 23.1 | 11.6 |
| FHD | 1080 | 15.4 | 7.7 |
| 2k4k | 2180 | 7.7 | 3.8 |

PIXEL CIRCUIT, DISPLAY DEVICE INCLUDING THE SAME AND DRIVING METHOD OF THE DISPLAY DEVICE

CROSS REFERENCE TO RELATED APPLICATIONS

This is a U.S. National Phase patent application of PCT/JP2013/070000, filed Jul. 24, 2013, which claims priority to Japanese Patent Application No. 2012-169593, filed Jul. 31, 2012, each of which is hereby incorporated by reference in the present disclosure in its entirety.

TECHNICAL FIELD

The present invention relates to pixel circuits, and more specifically, to a pixel circuit which includes electro-optic elements such as an organic EL (Electro Luminescence) element, to a display device including the same, and to a driving method of the display device.

BACKGROUND ART

Organic EL display devices are known for their thinness, high-quality image displaying capabilities and low power consumption. Organic EL display devices have a plurality of pixel circuits disposed in a matrix pattern. Each of the pixel circuits includes an organic EL element which is a self-luminous electro-optic element driven by an electric current; drive transistors; etc.

FIG. 17 is a circuit diagram which shows a configuration of a conventional pixel circuit 91. The pixel circuit 91 is disclosed in Patent Literature 1 for example. Note that hereinafter, the pixel circuit 91 shown in FIG. 17 may sometimes be called "referential prior art" for convenience. The pixel circuit 91 is disposed correspondingly to an intersection of a data line Dj (j represents a natural number) and a scanning line Si (i represents a natural number), and has one organic EL element OLED, two transistors T1, T2, and one capacitor C1. The transistor T1 is a drive transistor, whereas the transistor T2 is an input transistor. Transistors T1 and T2 are provided by n-channel thin-film transistors (Thin Film Transistor, hereinafter abbreviated as "TFT").

The transistor T1 is in series with the organic EL element OLED, has its drain terminal connected to a power supply line which supplies a HIGH level power supply voltage ELVDD (hereinafter called "HIGH level power supply line" and will be indicated with the same reference symbol ELVDD as the HIGH level power supply voltage), and has its source terminal connected to an anode terminal of the organic EL element OLED. The transistor T2 has its gate terminal connected to the scanning line Si, and is disposed between the data line Dj and the gate terminal of the transistor T1. The capacitor C1 has its one terminal connected to the gate terminal of the transistor T1, and the other terminal connected to the source terminal of the transistor T1. The organic EL element OLED has its cathode terminal connected to a power supply line which supplied a LOW level power supply voltage ELVSS (hereinafter called "LOW level power supply line" and will be indicated with the same reference symbol ELVSS as the LOW level power supply voltage). Hereinafter, in the description of the referential prior art, a term "gate node VG" will be used for the sake of convenience to refer to a point of connection between the gate terminal of the transistor T1, the one terminal of the capacitor C1 and a conduction terminal of the transistor T2 which is located on the gate terminal side of the transistor T1.

FIG. 18 is a timing chart for describing an operation of the pixel circuit 91 in FIG. 17. Before Time Point t1, the transistor T2 is in OFF state, and the gate node VG has its electric potential maintained at an initial level (e.g., a level corresponding to writing in the previous frame period). Upon Time Point t1, the scanning line Si is selected; the transistor T2 is turned ON; and a data voltage which represents a brightness of a pixel (sub-pixel) formed by the pixel circuit 91 in the i-th row (hereinafter called "data voltage in the i-th row" and will be indicated with a reference symbol Vdatai) is supplied to the gate node VG via the data line Dj and the transistor T2. Thereafter, for a period until Time Point t2 is reached, the electric potential at the gate node VG varies following the data voltage Vdatai. In this process, the capacitor C1 is charged with a differential potential between the potential at the gate node VG and a source potential of the transistor T1, i.e. to the gate-source voltage Vgs. When Time Point t2 is reached, the transistor T2 is turned OFF, finalizing the value of the gate-source voltage Vgs held by the capacitor C1. The transistor T1 supplies a drive current to the organic EL element OLED in accordance with the gate-source voltage Vgs held by the capacitor C1. As a result, the organic EL element OLED emits light at a brightness determined by the drive current. In addition to the above, Patent Literature 2, 3 disclose other pixel circuits and organic EL display devices relevant to the present invention.

DOCUMENTS ON CONVENTIONAL ART

Patent Documents

Patent Literature 1: Japanese Unexamined Patent Application Publication No. 2003-271095

Patent Literature 2: Japanese Unexamined Patent Application Publication No. 2005-31630

Patent Literature 3: Japanese Patent No. 4637070

SUMMARY OF INVENTION

Problems to be Solved by the Invention

FIG. 19 shows a length of one horizontal period (1 H-period) for each of various resolutions of HD (High Definition: 1280×720), FHD (Full High Definition: 1920×1080), and 2K4K (4096×2160). It should be noted here that 2K4K is also called 4K2K, 4K, etc. FIG. 19 uses a baseline provided by the FHD under 60 Hz driving (a case when the display device is driven so that its refreshing rate will be 60 Hz; namely, a case where drive frequency is 60 Hz). As shown in the Figure, 1 H-period in the 2K4K under 60 Hz driving is approximately ½, whereas 1 H-period in the 2K4K under 120 Hz driving (a case when the display device is driven so that its refreshing rate will be 120 Hz; namely, a case where drive frequency is 120 Hz) is approximately ¼. As understood, 1 H-period becomes shorter as whichever of the resolution and the drive frequency becomes higher. In other words, a selection period for each scanning line becomes shorter. If the selection period for each scanning line is not sufficient, it is impossible to perform sufficient writing of data voltage in the selection period for each scanning line. This results in a difficulty as shown in FIG. 18, in bringing the potential of the gate node VG to a target level. If the potential at the gate node VG does not reach the target level, it becomes impossible to charge the capacitor C1 to a desired voltage. As a result, display quality decreases.

Meanwhile, a CGS (Continuous Grain Silicon)-TFT, which is a type of low-temperature polysilicon TFT, has a typical mobility of approximately 100 $cm^2/V \cdot s$. On the other hand, amorphous silicon TFT (TFT having its channel layer formed with an amorphous silicon) has a typical mobility of approximately 0.5 $cm^2/V \cdot s$; whereas microcrystalline silicon TFT (TFT having its channel layer formed with a microcrystalline silicon) has a typical mobility of approximately 2 $cm^2/V \cdot s$; and IGZO-TFT, whose channel layer is formed of an oxide semiconductor InGaZnOx (hereinafter called "IGZO") which is an oxide semiconductor containing indium (In), gallium (Ga), zinc (Zn), and oxygen (O) as primary ingredients has a typical mobility of approximately 10 $cm^2/V \cdot s$. In cases where the transistor T2 is provided by an amorphous silicon TFT, microcrystalline silicon TFT, IGZO-TFT, etc. which have a significantly lower mobility than a CGS-TFT, it becomes impossible to supply a sufficient electric charge to the gate node VG within a selection period in which the transistor T2 maintains an ON state for each scanning line. In other words, it is impossible to sufficiently perform writing of a data voltage within a selection period for each scanning line. This poses the same problem as in the case where it is not possible to take sufficient selection period for each scanning line, i.e., that it becomes difficult to bring the potential of the gate node VG to a target level. Also, in cases where the transistor T2 is provided by an amorphous silicon TFT, microcrystalline silicon TFT, IGZO-TFT, etc., under a condition that it is impossible to take a sufficient selection period for each scanning line, then it will become even more difficult to bring the potential of the gate node VG to a target level.

It is therefore an object of the present invention to provide a pixel circuit which is capable of maintaining a display quality even in cases where the input transistor has a low mobility, or where it is impossible to take a sufficient selection period for each scanning line; to provide a display device including the pixel circuit; and to provide a driving method of the display device.

Solution to Problem

A first aspect of the present invention provides a pixel circuit disposed in an active matrix display device, correspondingly to one of data lines and to one of scanning lines which are to be selected sequentially. The circuit comprises:

an electro-optic element driven by an electric current;

a drive transistor which is disposed in series with the electro-optic element and controls a drive current to be supplied to the electro-optic element;

a drive capacitance element which holds a voltage for controlling the drive transistor;

a first input transistor which has its control terminal connected to a corresponding one of the scanning lines, and is disposed between a corresponding one of the data lines and the drive capacitance element; and a second input transistor which has its control terminal connected to a scanning line preceding the corresponding scanning line, and is disposed between the corresponding data line and the drive capacitance element.

A second aspect of the present invention provides the first aspect of the present invention, in which the control terminal of the second input transistor is connected to an immediately preceding scanning line of the corresponding scanning line.

A third aspect of the present invention provides the first aspect of the present invention, in which the pixel circuit further includes a third input transistor which has its control terminal connected to one of the scanning lines preceding the corresponding scanning line not connected to the control terminal of the second input transistor, and is disposed between the corresponding data line and the drive capacitance element.

A fourth aspect of the present invention provides the first aspect of the present invention, in which the pixel circuit further includes an emission control transistor which is in series with the electro-optic element, and assumes an OFF state when the scanning line which is connected to one of the control terminal of the first input transistor and the control terminal of the second input transistor is in a selected state.

A fifth aspect of the present invention provides the first aspect of the present invention, in which the first input transistor is provided by a thin-film transistor having its channel layer formed of an oxide semiconductor, a microcrystalline silicon or an amorphous silicon.

A sixth aspect of the present invention provides an active matrix display device including:

the pixel circuit according to one of Claims 1 through 5; and a scanning driving section which make sequential selection of the scanning lines.

A seventh aspect of the present invention provides a driving method of active matrix display device including a display section which has: a plurality of data line; a plurality of scanning lines and a plurality of pixel circuits disposed correspondingly to the plurality of data lines and the plurality of scanning lines. The pixel circuit includes: an electro-optic element driven by an electric current; a drive transistor which is disposed in series with the electro-optic element and controls a drive current to be supplied to the electro-optic element; and a drive capacitance element which holds a voltage for controlling the drive transistor;

the method includes:

a scanning step of sequentially selecting the scanning lines;

a first input step of electrically connecting one of the data lines which corresponds to the pixel circuit to the drive capacitance element in the pixel circuit, upon selection of one of the scanning lines which corresponds to the pixel circuit; and a second input step of electrically connecting one of the data lines which corresponds to the pixel circuit to the drive capacitance element in the pixel circuit, upon selection of one of the scanning lines which precedes the scanning line that corresponds to the pixel circuit.

Advantages of the Invention

According to the first aspect of the present invention, a voltage is supplied from a data line to a drive capacitance element via the second input transistor before a voltage is supplied from the data line to the drive capacitance element via the first input transistor. In other words, a preliminary charging is performed when selection is made to a preceding scanning line which precedes a scanning line corresponding to the pixel circuit. Therefore, the drive capacitance element is charged to a desired voltage even in cases where the first input transistor has a relatively low electron mobility or where it is not possible to take sufficient selection period for each scanning line. This makes a display device which includes the pixel circuit according to the first aspect of the present invention capable of maintaining a display quality.

According to the second aspect of the present invention, a preliminary charging is performed when selection is made to an immediately preceding scanning line which immediately precedes the scanning line corresponding to the pixel circuit. In general images, mutually adjacent pixels are alike, so two pixel circuits adjacent to each other in the direction in which the data line extends are similar to each other in terms of the voltage which must be supplied to their respective drive capacitance elements via the data line. For this reason, the preliminary charging performed when selection is made to the scanning line which immediately precedes the scanning line that corresponds to the pixel circuit brings the voltage of the charge in the drive capacitance element closer to a desired voltage. This makes it possible to maintain a level of display quality more reliably.

According to the third aspect of the present invention, another preliminary charging is performed by using the third input transistor. This brings the voltage of the charge in the drive capacitance element even closer to the desired voltage. This makes it possible to maintain a level of display quality more reliably.

According to the fourth aspect of the present invention, the emission control transistor stops the supply of drive current to the electro-optic element during a period in which the preliminary charging takes place in the pixel circuit (hereinafter, this period will be called "preliminary charging period" in this ADVANTAGES OF THE INVENTION) and during a period in which writing takes place to write a data voltage representing a brightness of the pixel provided by the pixel circuit (hereinafter, this period will be called "main charging period" in this ADVANTAGES OF THE INVENTION). This suppresses abnormal emission of the electro-optic element which can occur during the preliminary charging period or the main charging period.

According to the fifth aspect of the present invention, the same advantages as offered by the first aspect of the present invention are obtained by using an oxide TFT, a microcrystalline silicon TFT or an amorphous silicon TFT as the first input transistor.

According to the sixth aspect of the present invention, the same advantages as offered by the first aspect of the present invention are offered in a display device.

According to the seventh aspect of the present invention, the same advantages as offered by the first aspect of the present invention are offered in a driving method of the display device.

BRIEF DESCRIPTION OF DRAWINGS

FIG. 19 shows a length of 1 H-period for each of various resolutions.

DESCRIPTION OF EMBODIMENTS

Hereinafter, a first through a fourth embodiments of the present invention will be described with reference to the attached drawings. Hereinafter, m and n each represent an integer not smaller than 2, i represents an integer not smaller than 1 but not greater than n, and j represents an integer not smaller than 1 but not greater than m. Transistors included in pixel circuits according to each of the embodiments are provided by field-effect transistors, typically by TFTs. Examples of transistors which may would be included in pixel circuits may be provided by amorphous silicon TFTs, microcrystalline silicon TFTs, oxide TFTs represented by IGZO-TFT, etc. On the other hand, transistors included in pixel circuits may also be provided by CGS-TFTs, etc.

1. First Embodiment

1.1 Overall Configuration

Figure 1:
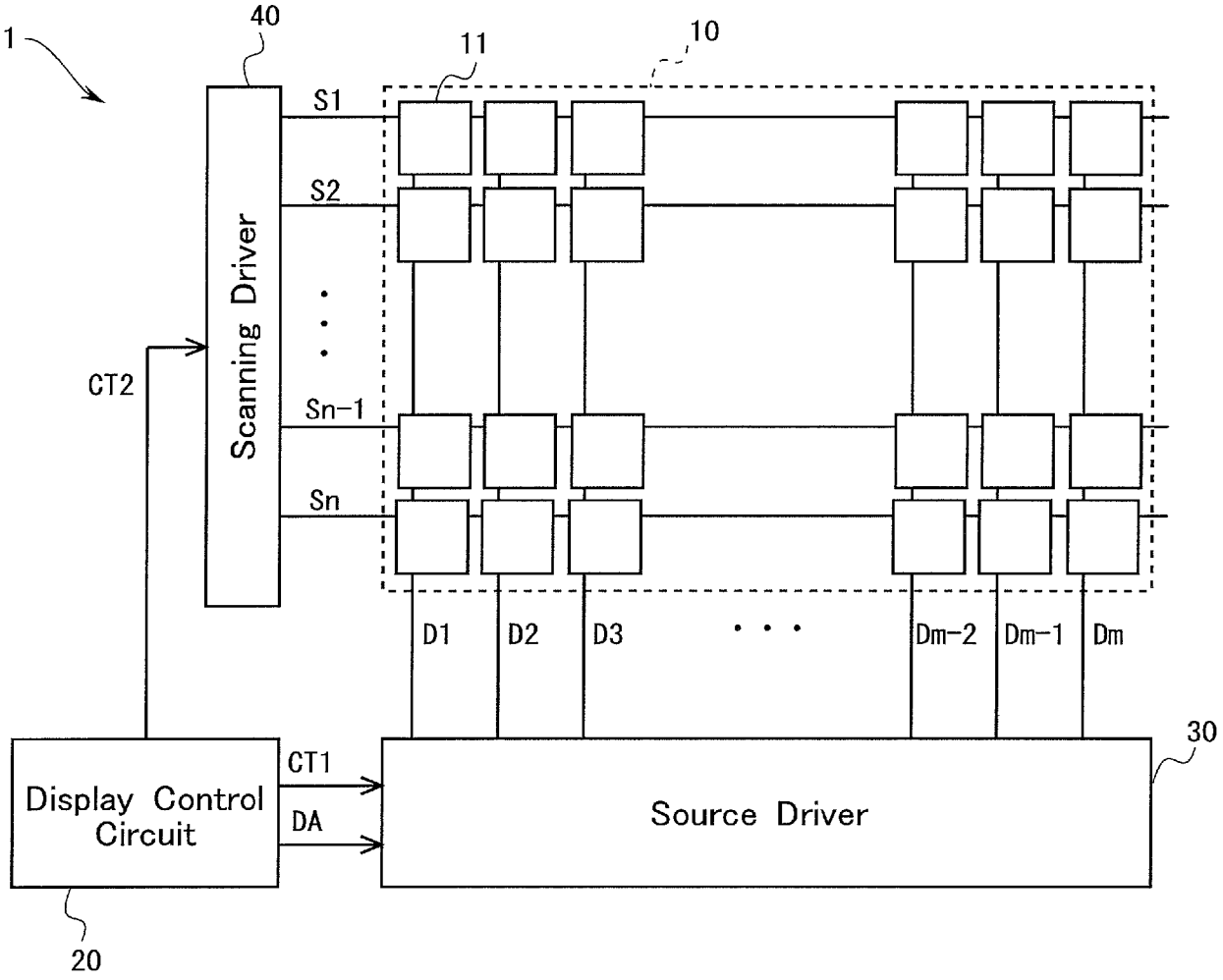
FIG. 1 is a block diagram showing a configuration of an organic EL display device which includes pixel circuits according to a first embodiment of the present invention.

FIG. 1 is a block diagram showing a configuration of an active matrix organic EL display device 1 which includes pixel circuits 11 according to a first embodiment of the present invention. The organic EL display device 1 includes a display section 10, a display control circuit 20, a source driver 30, and a scanning driver 40. In the present embodiment, the source driver 30 represents the data driving section, whereas the scanning driver 40 represents the scanning driving section. One or both of the source driver 30 and the scanning driver 40 may be formed integrally with the display section 10.

The display section 10 has as many as m data lines D1 through Dm, and perpendicular thereto, n scanning lines S1 through Sn. Hereinafter, the direction in which the data lines extend will be called column direction, whereas the direction in which the scanning lines extend will be called row direction. Also, an array of constituent elements along the column direction may sometimes be called "column", whereas an array of constituent elements along the row direction may be called "row". The display section 10 further has m×n pixel circuits 11 correspondingly to the m data lines D1 through Dm and the n scanning lines S1 through Sn. Each pixel circuit 11 serves as one of a red sub-pixel (hereinafter called "R sub-pixel"), a green sub-pixel (hereinafter called "G sub-pixel") and a blue sub-pixel (hereinafter called "B sub-pixel"). The pixel circuits 11 along the row direction constitutes the R sub-pixel, the G sub-pixel, and the B sub-pixel in this order for example, from a side closer to the scanning driver 40. The colors represented by the sub-pixels are not limited to red, green and blue, but may be cyan, magenta, yellow, etc. The display section 10 also includes unillustrated power lines, i.e., a HIGH level power supply line ELVDD and a LOW level power supply line ELVSS, disposed therein. HIGH level power supply voltage ELVDD and LOW level power supply voltage ELVSS are each fixed voltages. The LOW level power supply voltage ELVSS is a grounding voltage for example.

The display control circuit 20 controls the source driver 30 and the scanning driver 40 by sending image data DA and a source control signal CT1 to the source driver 30 while sending a scanning control signal CT2 to the scanning driver 40. The source control signal CT1 contains, for example, a source start pulse signal, a source clock signal and a latch strobe signal. The scanning control signal CT2 contains, for example, a scanning start pulse signal and a scanning clock signal.

The source driver 30 is connected to the m data lines D1 through Dm, and drives them. More specifically, the source driver 30 has such unillustrated components as a shift register, a sampling circuit, a latch circuit, m D/A converters and m buffers. The shift register makes sequential transfer of the source start pulse in synchronization with the source clock, thereby making a sequential output of the sampling pulse. The sampling circuit sequentially stores one-row amount of image data DA following the timing given by the sampling pulse. The latch circuit receives and stores the one-row amount of image data DA held by the sampling circuit, in accordance with the latch strobe signal, while it supplies image data DA (hereinafter called "gradation data") contained in the one-row amount of image data for each sub-pixel to a corresponding one of the D/A converters. The D/A converter converts the supplied gradation data into a data voltage, and outputs the voltage. The data voltage outputted from the D/A converter is then supplied to a corresponding one of the data lines via a corresponding one of the buffers.

The scanning driver 40 is connected to the n scanning lines S1 through Sn, and drives them. More specifically, the scanning driver 40 has such unillustrated components as a shift register, n buffers, etc. The shift register makes sequential transfer of the scanning start pulse in synchronization with the scanning clock signal. The output signal from each stage of the shift register is then supplied to a corresponding one of the scanning lines via a corresponding one of the buffers. Thus, the scanning driver 40 makes sequential selection from the n scanning lines S1 through Sn, starting from the scanning line S1.

1.2 Pixel Circuit

Figure 2:
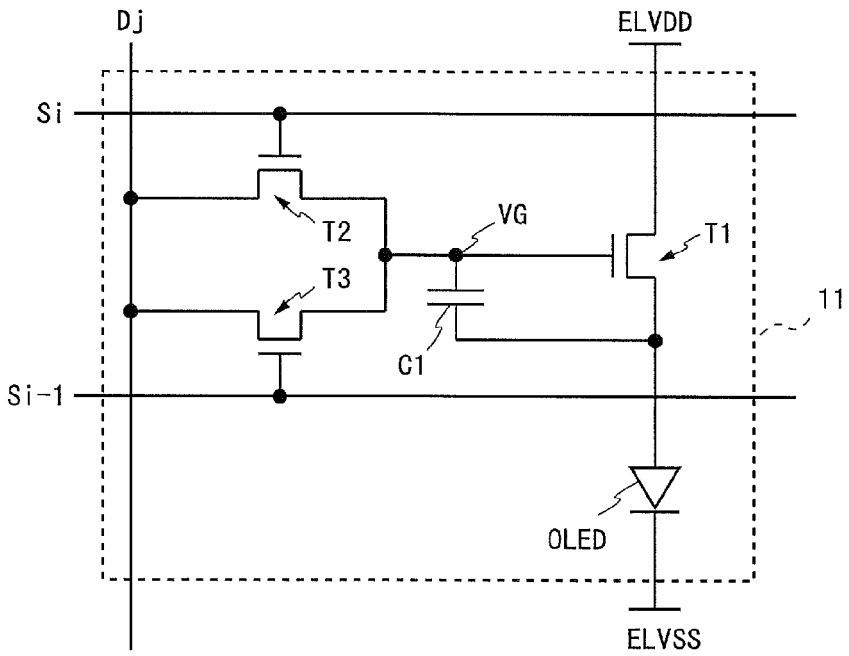
FIG. 2 is a circuit diagram showing a configuration of the pixel circuit in FIG. 1.

FIG. 2 is a circuit diagram showing a configuration of a pixel circuit located in the i-th row of the j-th column of the device shown in FIG. 1. The pixel circuit 11 has one organic EL element OLED, three transistors T1 through T3, and one capacitor C1. The transistor T1 is a drive transistor, the transistor T2 is a first input transistor, and the transistor T3 is a second input transistor. The capacitor C1 represents the drive capacitance element, whereas the organic EL element OLED represents the electro-optic element driven by the electric current. All of the transistors T1 through T3 are n-channel TFTs.

The transistor T1 is in series with the organic EL element OLED, and has its drain terminal, which serves as the first conduction terminal, connected to the HIGH level power supply line ELVDD while its source terminal, which serves as the second conduction terminal, is connected to the anode terminal of the organic EL element OLED. The transistor T2 has its gate terminal (which serves as the control terminal; the same applies to gate terminals of the other transistors) connected to the scanning line Si in the i-th row, and is between the data line Dj and the gate terminal of the transistor T1. The transistor T3 has its gate terminal connected to the scanning line Si−1, i.e., the scanning line in the (i−1)th row which is immediately before the scanning line Si in the i-th row; and is between the data line Dj and the gate terminal of the transistor T1. The term "the scanning line immediately before" refers to a scanning line which is immediately before in terms of the sequence of selection. The capacitor C1 has its one terminal connected to the gate terminal of the transistor T1, and the other terminal connected to the source terminal of the transistor T1. The capacitor C1 holds a voltage VGS across the gate and the source of the transistor T1. The organic EL element OLED has its cathode terminal connected to the LOW level power supply line ELVSS. Hereinafter, a term "gate node VG" will be used for the sake of convenience to refer to a point of connection between the gate terminal of the transistor T1, the one terminal of the capacitor C1 and a conduction terminal of the transistor T2 which is located on the gate terminal side of the transistor T1. Differing from the referential prior art described earlier, the gate node VG in the present embodiment is connected to a conduction terminal of the transistor T3 which is located on the gate terminal side of the transistor T1.

1.3 Operation

Figure 3:
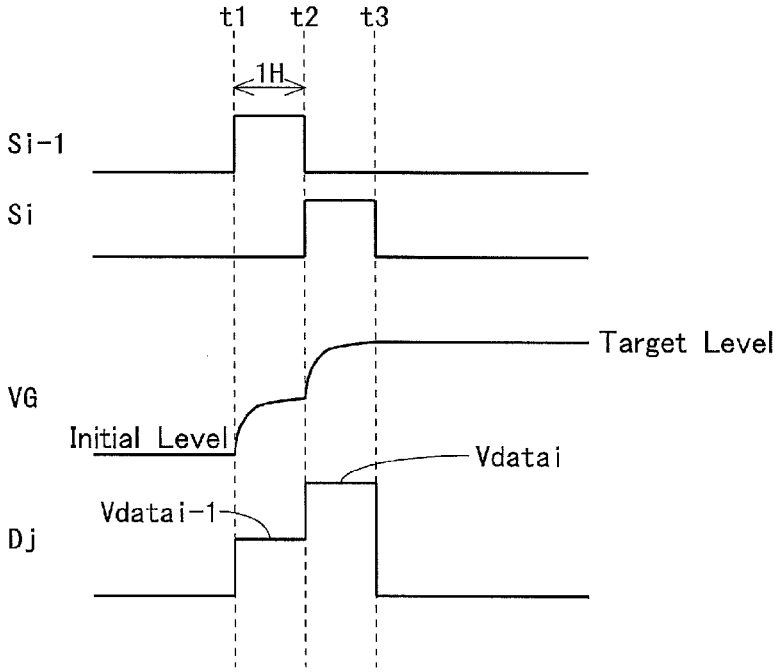
FIG. 3 is a timing chart for describing an operation of the pixel circuit in FIG. 2.

FIG. 3 is a timing chart for describing an operation of the pixel circuit 11 in FIG. 2. FIG. 3 includes a waveform chart at the gate node VG, which represents the potential at the gate node VG of the pixel circuit 11 in the i-th row, j-th column. In FIG. 3, and in FIG. 4(A) and FIG. 4(B) which will be described later, a period from Time Points t1 through t2 is a selection period for the scanning line Si−1 in the (i−1)th row and also a period for performing a preliminary charging (hereinafter called "preliminary charging period") in the pixel circuit 11 in the i-th row. Likewise, the period from Time Points t2 through t3 is a selection period for the scanning line Si in the i-th row, and a writing period (hereinafter called "main charging period") for writing a data voltage Vdatai in the i-th row to the pixel circuit 11 in the i-th row. The selection period for each scanning line is 1 H-period. Hereinafter, the selection period for the scanning line Si in the i-th row will be called "selection period for the i-th row".

Before Time Point t1, the scanning lines Si−1 and Si in the (i−1)th row and the i-th row assume LOW level. Under this state, the transistors T2, T3 are in OFF state, so the gate node VG maintains an initial potential level. Thus, the transistor T1 supplies a drive current determined by the initial level, to the organic EL element OLED, and the organic EL element OLED is emitting light at a brightness determined by the drive current. The initial level is, for example, an electric potential in accordance with the writing in the previous frame period. It should be noted here that the initial level may be set to a ground potential by selecting all the scanning lines and bringing all the data lines to a ground potential during the blanking period after all the scanning lines are scanned.

Upon reaching Time Point t1, the scanning line Si−1 in the (i−1)th row changes its state to HIGH level, so the transistor T3 turns ON. As a result, a data voltage Vdatai−1 in the (i−1)th row is supplied to the gate node VG via the data line Dj and the transistor T3. Thereafter, for a period till Time Point t2 is reached, the potential at the gate node VG varies following the data voltage Vdatai−1 in the (i−1)th row. In this process, the capacitor C1 is charged with a differential potential between the potential at the gate node VG and a source potential of the transistor T1, i.e. to the gate-source voltage Vgs. Thus, a preliminary charging is performed in the present embodiment, in the pixel circuit 11 in the i-th row during the selection period (preliminary charging period) of the (i−1)th row. The preliminary charging as described above brings the potential at the gate node VG closer to a target level (Vdatai) which must be achieved in the selection period of the i-th row. The preliminary charging will be described later in more detail.

When Time Point t2 is reached, the scanning line Si−1 in the (i−1)th row changes its state to LOW level, so the transistor T3 turns OFF. Also, the scanning line Si in the i-th row changes its state to HIGH level, so the transistor T2 turns ON. As a result, the data voltage Vdatai in the i-th row is supplied to the gate node VG via the data line Dj and the transistor T2. Thereafter, for a period until Time t3 is reached, the potential at the gate node VG varies following the data voltage Vdatai in the i-th row. In this process, the capacitor C1 is charged with a differential potential between the potential at the gate node VG and a source potential of the transistor T1, i.e. to the gate-source voltage Vgs. More specifically, since the above-described preliminary charging has already brought the potential at the gate node VG close to the data voltage Vdatai in the i-th row, the potential at the gate node VG reliably achieves Vdatai in the selection period of the i-th row (main charging period). In the selection period of the i-th row, the gate-source voltage Vgs to which the capacitor C1 is charged is given by the following Mathematical Expression (1):

$$Vgs = VG - VS \quad (1)$$
$$= Vdatai - VS$$

where VS represents the source potential of the transistor T1, and is assumed as a constant for the convenience of description.

When Time Point t3 is reached, the scanning line Si in the i-th row changes its state to LOW level, so the transistor T2 turns OFF. This finalizes the value of the gate-source voltage Vgs held by the capacitor C1 to the value given by Mathematical Expression (1). The transistor T1 supplies a drive current Ioled to the organic EL element OLED depending upon the gate-source voltage Vgs held by the capacitor C1. More specifically, the drive current Ioled supplied from the transistor T1 to the organic EL element OLED is given by the following Mathematical Expression (2):

$$Ioled = (\beta/2)*(Vgs - Vth)^2 \quad (2)$$
$$= (\beta/2)*(Vdatai - VS - Vth)^2$$

where βrepresents a gain of the transistor T1, which is proportional to electron mobility of the transistor T1 for example. As indicated by the above Mathematical Expression (2), the drive current Ioled takes a value which is determined by the data voltage Vdatai in the i-th row, and therefore the organic EL element OLED makes emission at a brightness determined by the data voltage Vdatai in the i-th row.

1.4 Preliminary Charging

Figure 4:
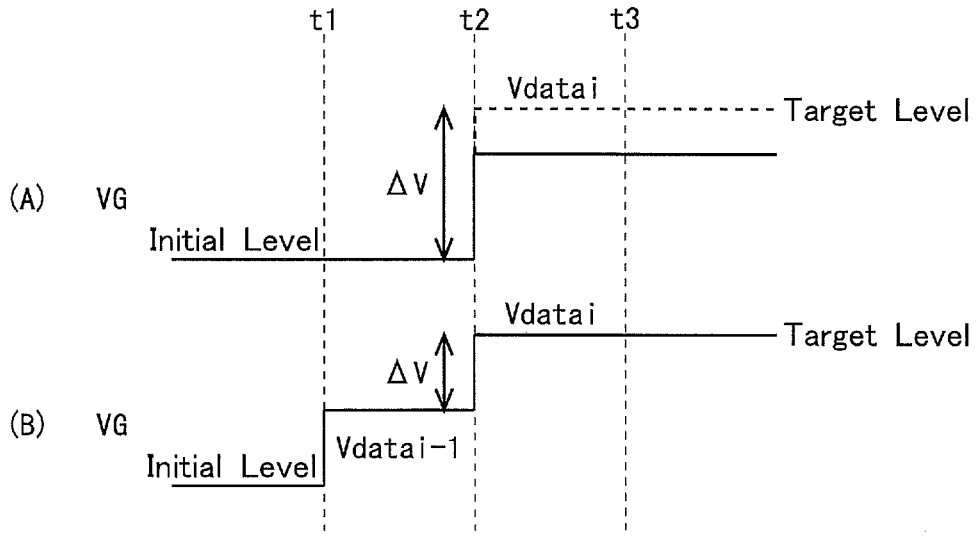
FIG. 4 shows timing charts (A, B) for comparison between a referential prior art and the first embodiment. Chart (A) is for describing an operation of the referential prior art. Chart (B) is for describing a preliminary charging operation in the first embodiment.

FIG. 4 is a timing chart for comparison between the referential prior art described earlier and the present embodiment. More specifically, FIG. 4(A) is a timing chart for describing an operation of the referential prior art, whereas FIG. 4(B) is a timing chart for describing an operation in the preliminary charging according to the present embodiment. For the sake of drawing convenience, FIG. 4(A) and FIG. 4(B) do not show waveform deterioration at the gate node VG.

As shown in FIG. 4(A), in the referential prior art, a data voltage is not supplied to the gate node VG until the selection period of the i-th row, and only when the selection period of the i-th row is reached, there is a supply of the data voltage Vdatai in the i-th row to the gate node VG. Under this condition, in order for the potential at the gate node VG in the selection period of the i-th row to achieve the target level (Vdatai), there must be a supply of electric potential (hereinafter called "shift electric potential" and will be indicated with a reference symbol ΔV) which is a difference between the target level and the initial level and thus is a relatively large value. In the selection period of the i-th row, the gate node VG requires an amount of time (hereinafter called "charging time" and will be indicated with a reference symbol T) for reaching the target level (Vdatai), which is given by the following Mathematical Expression (3).

$$T = C1*\Delta V/Id \quad (3)$$

where, Id represents an electric current supplied from the transistor T2 to the capacitor C1 (the gate node VG) (hereinafter called writing current), which is constant as far as the transistor T2 operates in its saturated range. The writing current Id is proportional to a mobility of the transistor T2. In the present DESCRIPTION, an operation of the transistor T2 when it is operating in its linear region will not be explained. From Mathematical Expression (3), it is understood that when the writing current Id is smaller, i.e., when the mobility of the transistor T2 is lower, the charging time T is longer. In this case, even if a somewhat sufficient time is made available as the selection period of the scanning line Si in the i-th row, there is still a possibility that the potential at the gate node VG will not reach the target level. Also, if a sufficient time is not made available as the selection period of the i-th row, there is a possibility that the potential at the gate node VG will not reach the target level even if the transistor T2 has a somewhat high mobility.

In contrast, in the present embodiment, as shown in FIG. 4(B), a preliminary charging is performed in the selection period of the (i−1)th row to make an advanced supply of the data voltage Vdatai−1 in (i−1)th row to the gate node VG. Now, in images in general (e.g., natural images), mutually adjacent pixels are alike, so two pixel circuits 11 adjacent to each other in the column direction are similar to each other in terms of data voltages which must be supplied to their relevant capacitors C1. In other words, a data voltage Vdatai−1 in the (i−1)th row and a data voltage Vdatai in the i-th row are similar to each other. For this reason, the preliminary charging performed in the selection period of the (i−1)th row brings the potential at the gate node VG to a level close to the target level (Vdatai) which must be achieved in the selection period of the i-th row. Specifically, the potential at the gate node VG attains the Vdatai−1 or attains a level close to the Vdatai−1. Hereinafter, description of the present embodiment will assume that the potential at the gate node VG attains the Vdatai−1 in the selection period of the (i−1)th row.

Thereafter, in the selection period of the i-th row, the data voltage Vdatai in the i-th row is supplied to the gate node VG. Differing from the case of the referential prior art, the shift electric potential ΔV in the present embodiment is relatively small since it is a difference between the target level Vdatai and a value Vdatai−1 which has a value close to Vdatai. Hence, the charging time T given by Mathematical Expression (3) is shorter than in the referential prior art and therefore, the potential at the gate node VG easily reaches the target level even in cases where the transistor T2 has a low mobility or where a sufficient amount of time is not available for the selection period of the i-th row.

Figure 5:
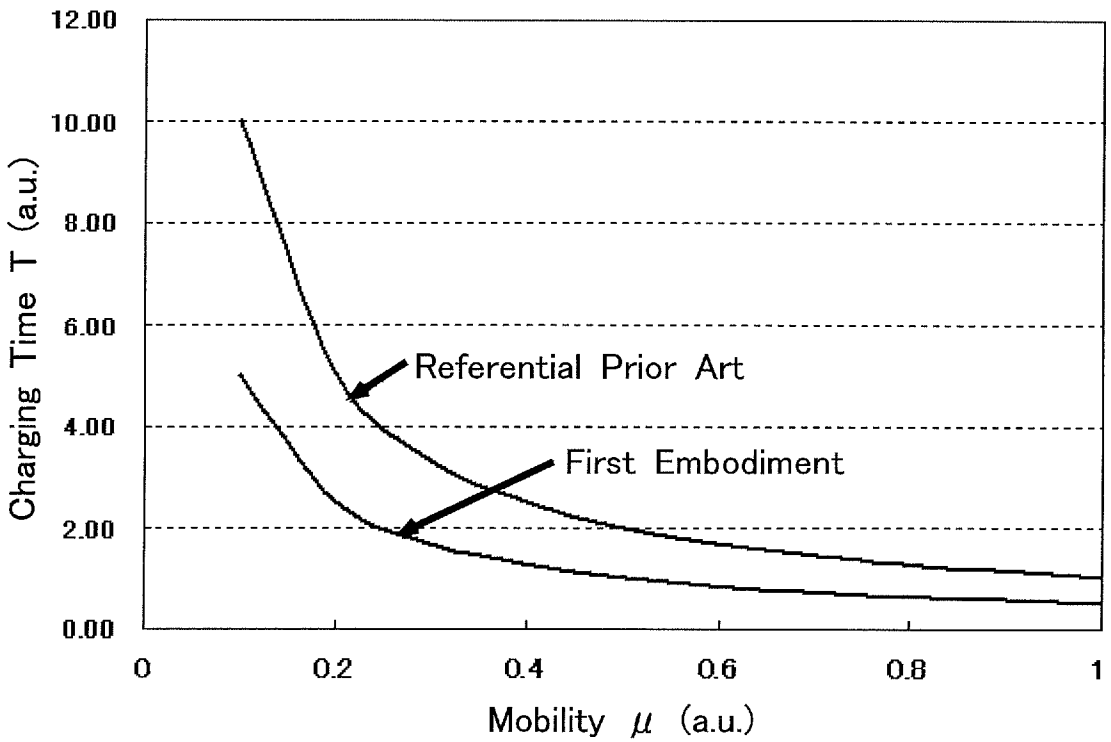
FIG. 5 shows a result of a comparative simulation of the referential prior art and the first embodiment.

FIG. 5 shows a result of a comparative simulation of the referential prior art and the present embodiment. The horizontal axis in FIG. 5 and in FIG. 13 which will be described later represents the mobility μ of the transistor T2, whereas the vertical axis represents the charging time T. The lower is the mobility μ, the longer is the charging time T. As shown in FIG. 5, in the present embodiment in which the above-described preliminary charging is performed, the charging time T is shorter (approximately 50%) as compared to the referential prior art. Also, a difference between the charging time T in the referential prior art and the charging time Tin the present embodiment, i.e., the amount of reduction in charging time T, becomes greater as the mobility μ is lower.

1.5 Advantages

According to the present embodiment, the capacitor C1 is supplied with the data voltage Vdatai−1 in (i−1)th row from the data line Dj via the transistor T3, before the capacitor C1 is supplied with the data voltage Vdatai in the i-th row from the data line Dj via the transistor T2. In other words, a preliminary charging is performed in the selection period when the immediately preceding scanning line Si−1 is selected. Namely, there is a preliminary charging period before the main charging period. Therefore, the capacitor C1 is charged to a desired gate-source voltage Vgs even in cases where the transistor T2 has a relatively low electron mobility μ or where it is not possible to take sufficient selection period for each scanning line. This makes it possible to maintain a level of display quality. The present embodiment is suitable for cases where the transistor T2 is provided by a TFT which has a relatively low mobility, such as an oxide TFT, a microcrystalline silicon TFT, or an amorphous silicon TFT. However, even in cases where the transistor T2 is provided by a TFT which has a relatively high electron mobility such as a CGS-TFT, the preliminary charging will ensure that a level of display quality is reliably maintained in cases where each scanning line has a relatively short selection period.

According to the present embodiment, the preliminary charging period is provided by a 1 H-period which is immediately before the main charging period. In general images, mutually adjacent pixels are alike, so two pixel circuits 11 adjacent to each other in the column direction have similar data voltages to each other. Under this situation, the preliminary charging performed immediately before the main charging period brings the gate-source voltage Vgs, i.e., a charge in the capacitor C1, closer to a desired value. This makes it possible to maintain a level of display quality more reliably.

2. Second Embodiment

2.1 Overall Configuration

Figure 6:
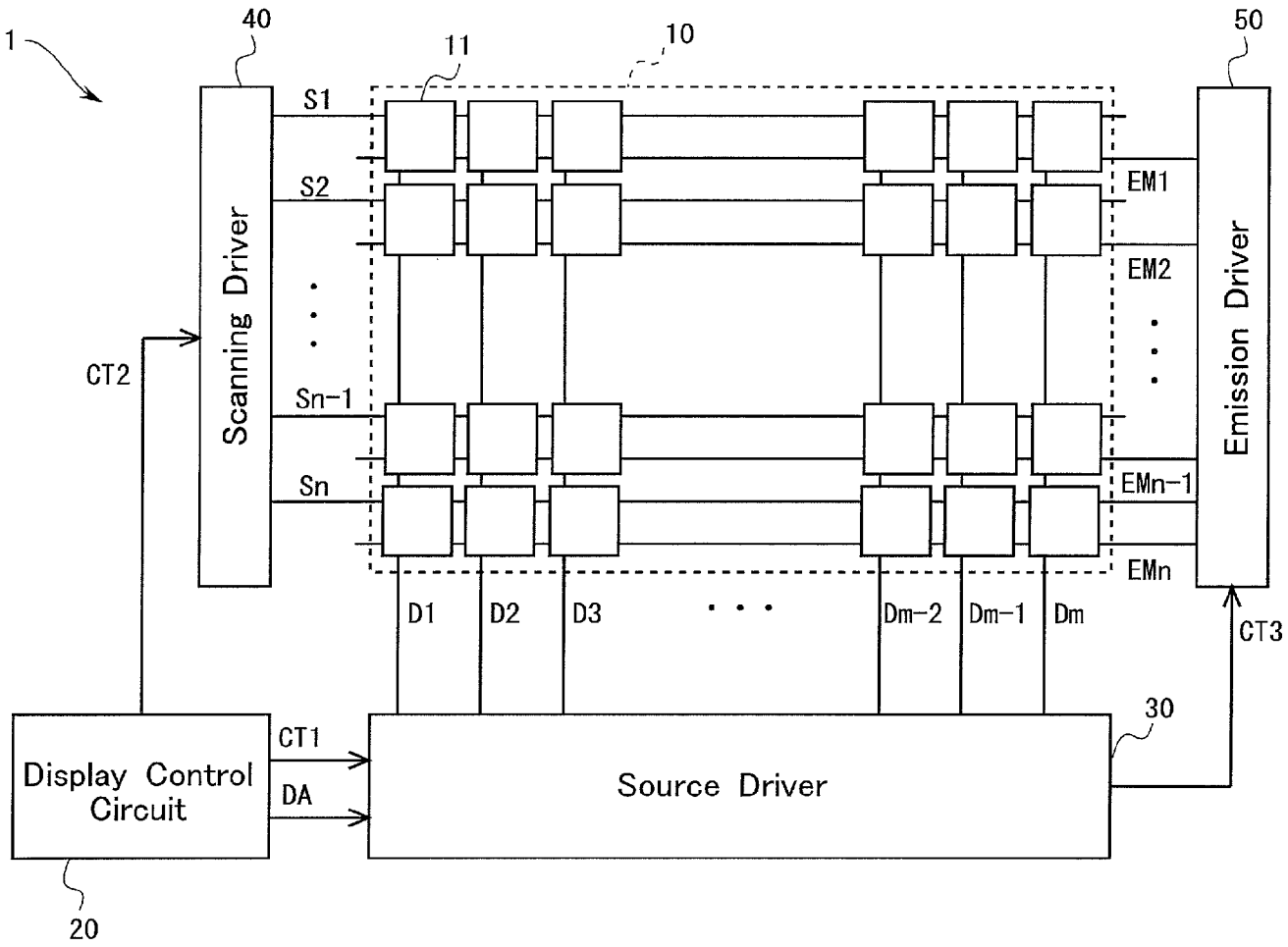
FIG. 6 is a block diagram showing a configuration of an organic EL display device which includes a pixel circuit according to a second embodiment of the present invention.

FIG. 6 is a block diagram showing a configuration of an active matrix organic EL display device 1 which includes pixel circuits 11 according to a second embodiment of the present invention. Constituent elements of the present embodiment which are identical with those in the first embodiment will be indicated with the same reference symbols, without repeating description thereof when appropriate. The organic EL display device 1 which includes the pixel circuits 11 according to the present embodiment is the organic EL display device 1 which is shown in FIG. 1 but further includes an emission driver (emission control driving section) 50. The display section 10 according to the present embodiment includes n emission lines (emission control lines) EM1 through EMn, along the n scanning lines S1 through Sn.

The display control circuit 20 controls the emission driver 50 by sending an emission control signal CT3 to the emission driver 50. The emission control signal CT3 contains an emission start pulse and an emission clock signal, for example.

The emission driver 50 is connected to the n emission lines EM1 through EMn, and drives them. More specifically it includes an unillustrated shift register, n logic circuits, n buffers, etc. The shift register makes sequential transfer of the emission start pulse in synchronization with the emission clock signal. The logic circuit receives output signals from different stages in the shift register, and based on these, generates signals to be supplied to corresponding emission lines. These signals to be supplied to the emission lines are supplied to the corresponding emission lines via corresponding buffers. Thus, the emission driver 50 drives the n emission lines EM1 through EMn. The emission driver 50 may be formed integrally with the scanning driver 40. In this case, the shift registers, etc. are shared between the emission driver 50 and the scanning driver 40.

2.2 Pixel Circuit

Figure 7:
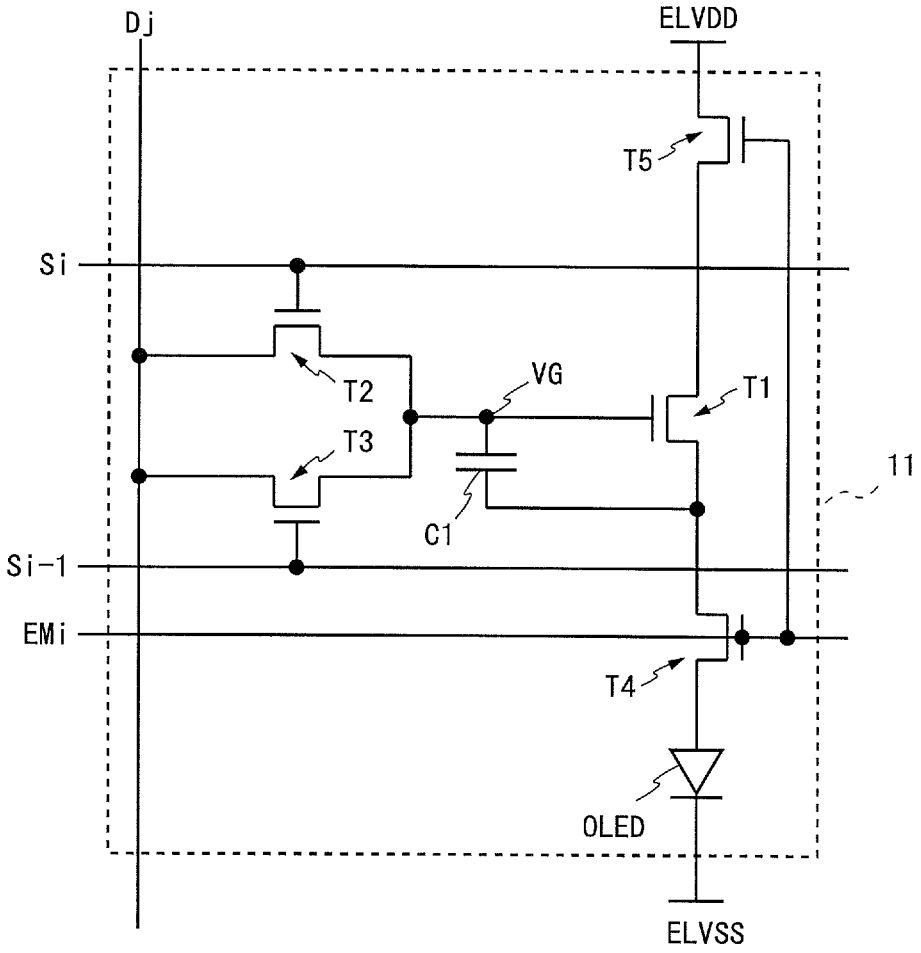
FIG. 7 is a circuit diagram showing a configuration of the pixel circuit in FIG. 6.

FIG. 7 is a circuit diagram which shows a configuration of the pixel circuit 11 in the i-th row, j-th column in FIG. 6. The pixel circuit 11 according to the present embodiment is the pixel circuit 11 in FIG. 2, further including transistors T4, T5. Each of the transistors T4, T5 serves as an emission control transistor. More specifically, the transistor T4 is a first emission control transistor, whereas the transistor T5 is a second emission control transistor. The transistors T4, T5 are n-channel TFTs, and there is no specific limitation to the type of the TFT. However, they may be provided by, for example, oxide TFTs represented by IGZO-TFTs, microcrystalline silicon TFTs or amorphous silicon TFTs. Alternatively, the transistors T4, T5 may be provided by CGS-TFTs, for example. The transistor T4 has its gate terminal connected to the emission line EMi in the i-th row, and is between the source terminal of the transistor T1 and the anode terminal of the organic EL element OLED. The transistor T5 has its gate terminal connected to the emission line EMi in the i-th row, and is between the HIGH level power supply line ELVDD and the drain terminal of the transistor T1. Other arrangements in the pixel circuit 11 according to the present embodiment is the same as those in the first embodiment.

2.3 Operation

Figure 8:
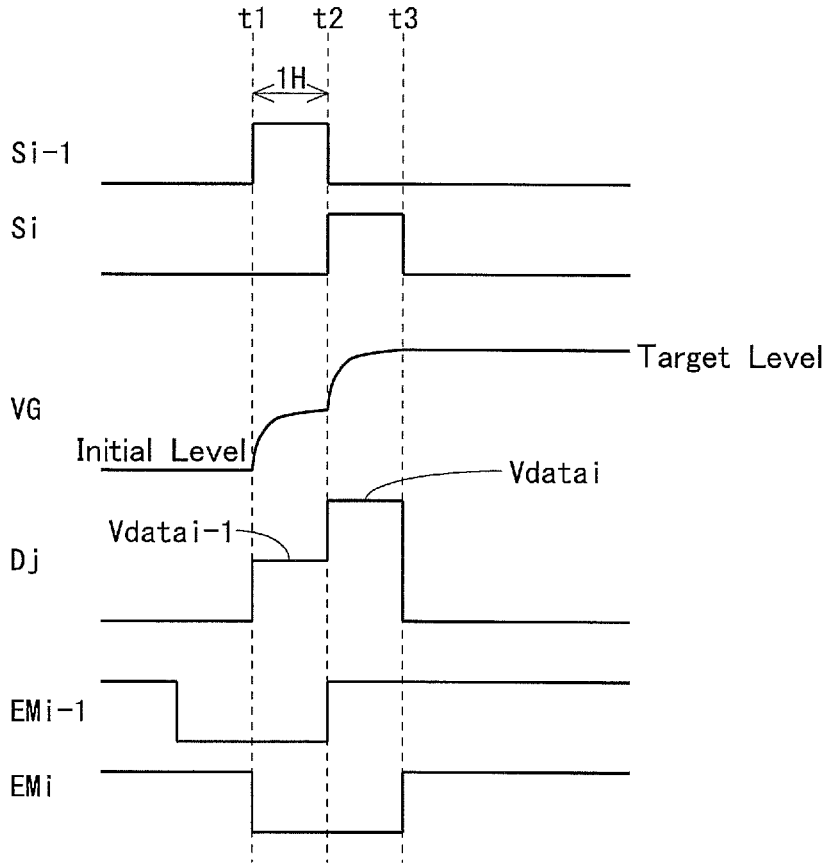
FIG. 8 is a timing chart for describing an operation of the pixel circuit in FIG. 7.

FIG. 8 is a timing chart for describing an operation of the pixel circuit 11 in FIG. 7. In FIG. 8, a period from Time Point t1 through t2 is a selection period of the (i−1)th row, and a preliminary charging period for the i-th row as well. Likewise, a period from Time Point t2 through t3 is a selection period of the i-th row, and a main charging period for the i-th row as well. Hereinafter, when part of the operation of the pixel circuit 11 according to the present embodiment are the same as of the first embodiment, description will not be made for those same parts as appropriately. As shown in FIG. 8, the emission line EMi in the i-th row assumes LOW level during selection periods for the scanning lines Si−1 and Si of the (i−1)th row and the i-th row. This LOW level period overlaps a LOW level period of the emission line EMi−1 in the (i−1)th row, for 1 H period.

Before Time Point t1, the scanning lines Si−1 and Si in the (i−1)th row and the i-th row assume LOW level, whereas the emission line EMi in the i-th row assumes HIGH level. Under this state, the transistors T2, T3 are in OFF state, so the gate node VG maintains an initial potential level. Also, the transistors T4, T5 assume ON state, providing electrical connection between the source terminal of the transistor T1 and the anode terminal of the organic EL element OLED, and electrical connection between the drain terminal of the transistor T1 and the HIGH level power supply line ELVDD. Thus, the transistor T1 supplies a drive current determined by the initial level, to the organic EL element OLED, and the organic EL element OLED is emitting light at a brightness determined by the drive current. As described above, the initial level is, for example, an electric potential corresponding to the reflecting the writing in the previous frame period. It should be noted here that the initial level may be set to a ground potential by selecting all the scanning lines and bringing all the data lines to a ground potential during the blanking period after all the scanning lines are scanned.

When Time Point t1 is reached, the emission line EMi in the i-th row changes its state to LOW level, so the transistors T4, T5 turn OFF. As a result, the electric connection between the source terminal of the transistor T1 and the anode terminal of the organic EL element OLED is cut off from each other, and the electric connection between the drain terminal of the transistor T1 and the HIGH level power supply line ELVDD is cut off from each other. As a result, the supply of the drive current Ioled by the transistor T1 to the organic EL element OLED is stopped and the organic EL element OLED stops its emission. This suppresses abnormal emission of the organic EL element OLED which can occur when supplying a data voltage to the gate node VG. The emission line EMi in the i-th row stays LOW level until Time Point t3. Also, upon Time Point t1, the scanning line Si−1 in the (i−1)th row changes its state to HIGH level, so the transistor T3 turns ON. Thus, like in the first embodiment, a preliminary charging takes place in the selection period of the (i−1)th row.

When Time Point t2 is reached, the scanning line Si−1 in the (i−1)th row changes its state to LOW level, so the transistor T3 turns OFF. Also, the scanning line Si in the i-th row changes its state to HIGH level, so the transistor T2 turns ON. Thus, like in the first embodiment, the capacitor C1 is charged to the gate-source voltage Vgs which has a value given by Mathematical Expression (1), in the selection period of the i-th row.

When Time Point t3 is reached, the scanning line Si in the i-th row changes its state to LOW level, so the transistor T2 turns OFF. This finalizes the value of the gate-source voltage Vgs held by the capacitor C1 to the value given by Mathematical Expression (1). Also, upon Time Point t3, the emission line EMi in the i-th row assumes HIGH level, which establishes the electric connection between the source terminal of the transistor T1 and the anode terminal of the organic EL element OLED, while establishing an electric connection between the drain terminal of the transistor T1 and the HIGH level power supply line ELVDD. This causes the transistor T1 to supply the drive current Ioled, which has a value given by Mathematical Expression (2), to the organic EL element OLED.

2.4 Advantages

According to the present embodiment, due to the transistors T4, T5, the source terminal of the transistor T1 and the anode terminal of the organic EL element OLED are electrically cut off from each other and the drain terminal of the transistor T1 and the HIGH level power supply line ELVDD are electrically cut off from each other in the preliminary charging period and the main charging period. This stops the supply of the drive current Ioled from the transistor T1 to the organic EL element OLED. This suppresses abnormal emission of the organic EL element OLED which can occur during the preliminary charging period or the main charging period. By using both of the transistors T4, T5, the supply of the drive current Ioled from the transistor T1 to the organic EL element OLED is reliably stopped. Therefore, it is possible to reliably suppress abnormal emission of the organic EL element OLED.

2.5 Variation

Figure 9:
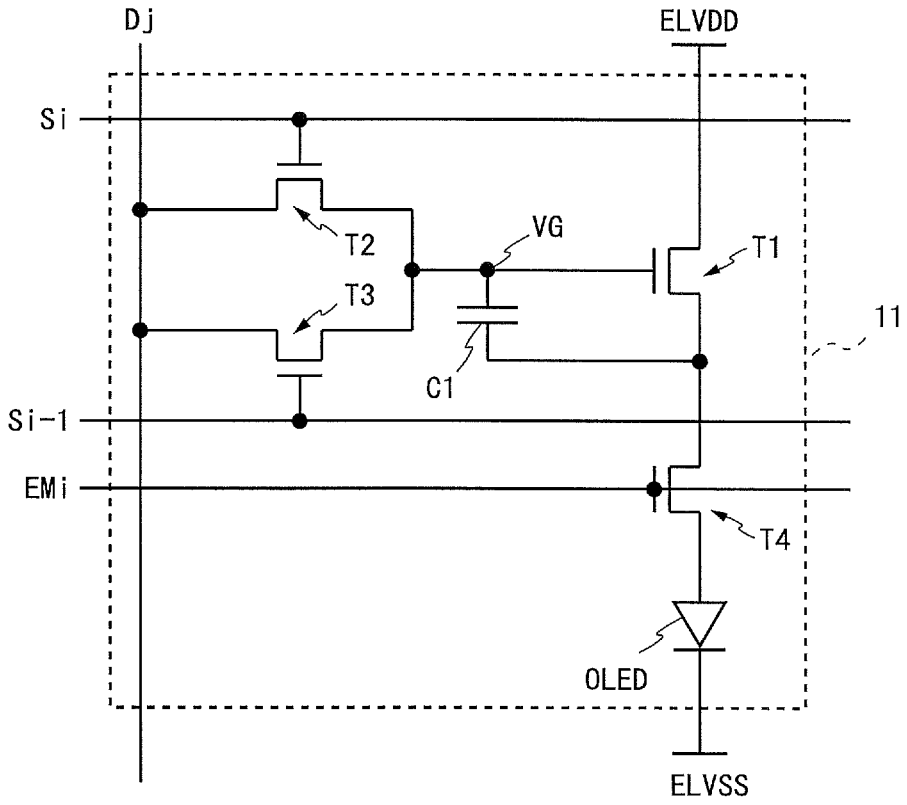
FIG. 9 is a circuit diagram showing a configuration of a pixel circuit according to a variation of the second embodiment.

FIG. 9 is a circuit diagram showing a configuration of a pixel circuit 11 according to a variation of the second embodiment. The pixel circuit 11 according to the present variation is the pixel circuit 11 in FIG. 7, without the transistor T5. Accordingly, the transistor T1 has its drain terminal connected to the HIGH level power supply line ELVDD. Other arrangements in the pixel circuit 11 according to the present variation are the same as those in the second embodiment. The pixel circuit 11 according to the present variation operates the same way as the circuit according to the second embodiment.

According to the present variation, it is possible to suppresses abnormal emission of the organic EL element OLED with a simple configuration without the transistor T5.

3. Third Embodiment

3.1 Pixel Circuit

Figure 10:
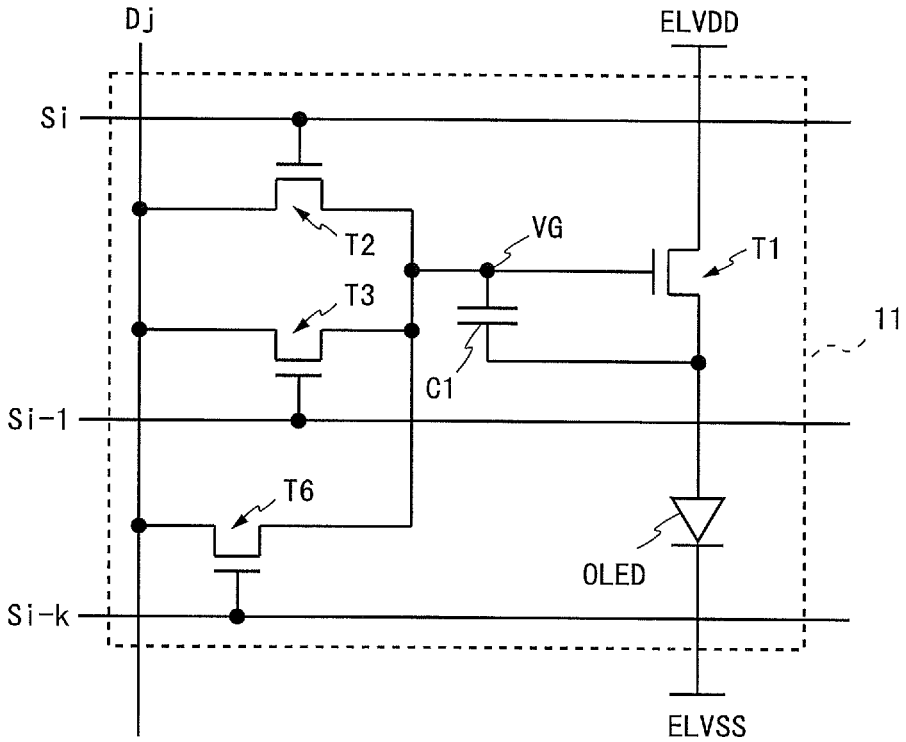
FIG. 10 is a circuit diagram showing a configuration of a pixel circuit according to a third embodiment of the present invention.

FIG. 10 is a circuit diagram showing a configuration of a pixel circuit 11 in the i-th row, j-th column according to a third embodiment of the present invention. The pixel circuit 11 according to the present embodiment is the pixel circuit 11 in FIG. 2, further including a transistor T6. In the present embodiment, one of the transistors T3, T6 serves as the second input transistor while the other serves as the third input transistor. The transistor T6 is an n-channel TFT, and there is no specific limitation to the type of the TFT. However, it may be provided by, for example, an oxide TFT represented by IGZO-TFTs, a microcrystalline silicon TFT or an amorphous silicon TFT. Alternatively, the transistor T6 may be provided by a CGS-TFT, for example. The transistor T6, disposed between the data line Dj and the gate terminal of the transistor T1, has its gate terminal connected to the scanning line Si-k in the (i-k)th row, (k represents a natural number not smaller than 2), which is a scanning line foregoing the scanning line Si−1 in the (i−1)th row to which the transistor T3 has its gate terminal connected. The term "foregoing scanning line" refers to a scanning line which is ahead in terms of the sequence of selection. Other arrangements in the pixel circuit 11 according to the present embodiment is the same as those in the first embodiment.

3.2 Operation

Figure 11:
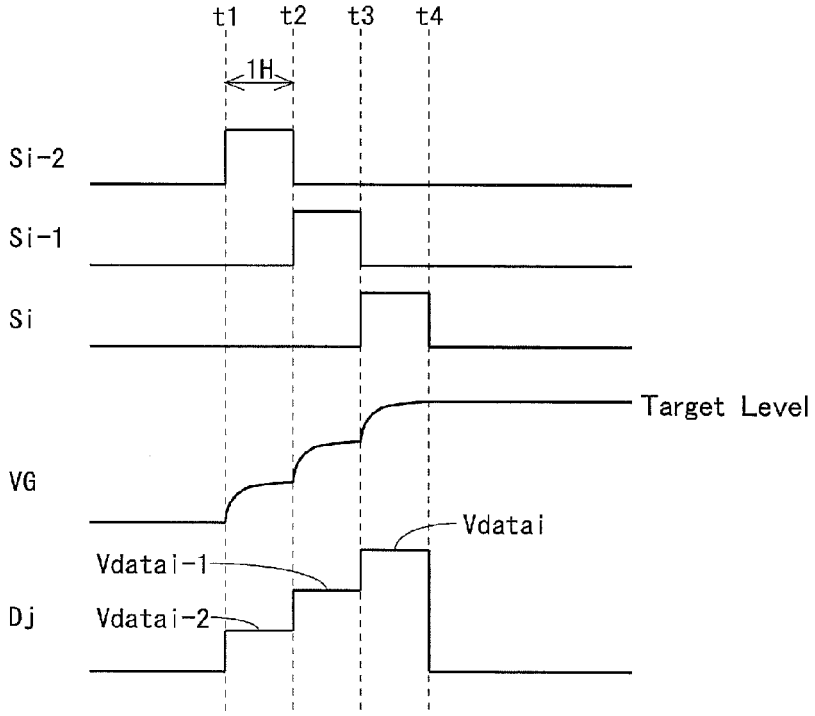
FIG. 11 is a timing chart for describing an operation of the pixel circuit in FIG. 10.

FIG. 11 is a timing chart for describing an operation of the pixel circuit 11 in FIG. 10. In this embodiment, k=2. In FIG. 11, and FIG. 12(A) and FIG. 12(B) which will be described later, a period from Time Points t1 through t2 is a selection period of the (i−2)th row and also a period for performing the first preliminary charging (hereinafter called "the first preliminary charging period") in the pixel circuit 11 in the i-th row. A period from Time Point t2 through t3 is a selection period of the scanning line Si−1 in the (i−1)th row, and also a period for performing the second preliminary charging (hereinafter called "the second preliminary charging period") in the pixel circuit 11 in the i-th row. Likewise, a period from Time Point t3 through t4 is a selection period of the scanning line Si in the i-th row, and a main charging period for the i-th row as well. Hereinafter, when part of the operation of the pixel circuit 11 according to the present embodiment is the same as of the first embodiment, description will not be made for that part as appropriately.

Before Time Point t1, the scanning lines Si−2 through Si in the (i−2)th row through the i-th row assume LOW level. Under this state, the transistors T2, T3, T6 are in OFF state, so the gate node VG maintains an initial potential level. Thus, the transistor T1 supplies a drive current determined by the initial level, to the organic EL element OLED, and the organic EL element OLED is emitting light at a brightness determined by the drive current.

Upon reaching Time Point t1, the scanning line Si−2 in the (i−2)th row changes its state to HIGH level, so the transistor T6 turns ON. As a result, a data voltage Vdatai−2 in the (i−2)th row is supplied to the gate node VG via the data line Dj and the transistor T6. Thereafter, for a period till Time Point t2 is reached, the potential at the gate node VG varies following the data voltage Vdatai−2 in the (i−2)th row. In this process, the capacitor C1 is charged with a differential potential between the potential at the gate node VG and a source potential of the transistor T1, i.e. to the gate-source voltage Vgs. Thus, the first preliminary charging is performed in the present embodiment, in the pixel circuit 11 in the i-th row during the selection period of the (i−2)th row. The preliminary charging as described above brings the potential at the gate node VG closer to a target level (Vdatai) which must be achieved in the selection period of the i-th row.

Upon reaching Time Point t2, the scanning line Si−2 in the (i−2)th row changes its state to LOW level, so the transistor T6 turns OFF. Also, the scanning line Si−1 in the (i−1)th row changes its state to HIGH level, so the transistor T3 turns ON. Thus, like in the first embodiment, a preliminary charging (the second preliminary charging, however, in the present embodiment) takes place in the selection period of the (i−1)th row. As described, in the present embodiment, a preliminary charging is performed in each of the selection period of the (i−2)th row (in the first preliminary charging period) and the selection period of the (i−1)th row (in the second preliminary charging period). In other words, a total of two times of preliminary charging take place.

When Time Point t3 is reached, the scanning line Si−1 in the (i−1)th row changes its state to LOW level, so the transistor T3 turns OFF. Also, the scanning line Si in the i-th row changes its state to HIGH level, so the transistor T2 turns ON. Thus, like in the first embodiment, the capacitor C1 is charged to the gate-source voltage Vgs having a value given by Mathematical Expression (1), in the selection period of the i-th row.

When Time Point t4 is reached, the scanning line Si in the i-th row changes its state to LOW level, so the transistor T2 turns OFF. This finalizes the value of the gate-source voltage Vgs held by the capacitor C1 to the value given by Mathematical Expression (1). This causes the transistor T1 to supply the drive current Ioled, which has a value given by Mathematical Expression (2), to the organic EL element OLED.

3.3 Preliminary Charging

Figure 12:
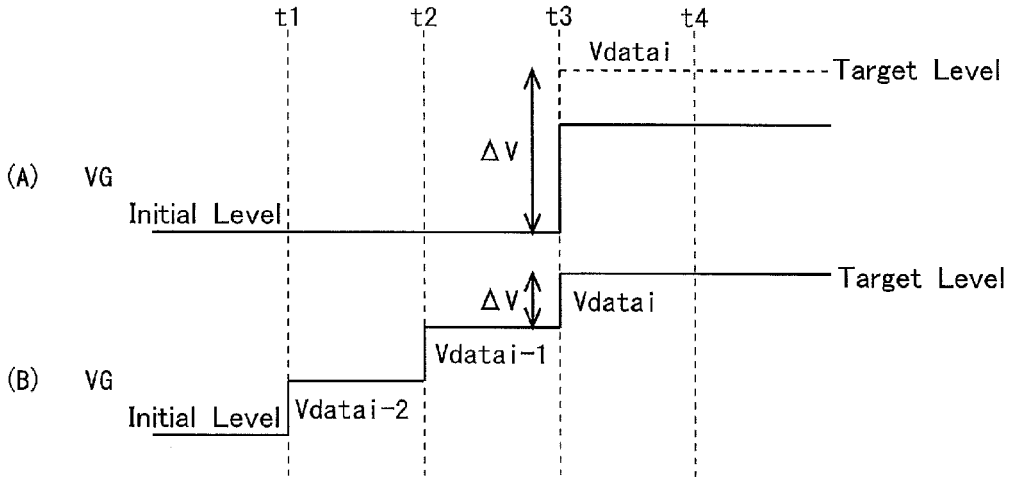
FIG. 12 shows timing charts (A, B) for comparison between the referential prior art and the third embodiment. Chart (A) is for describing an operation of the referential prior art. Chart (B) is for describing a preliminary charging operation in the third embodiment.

FIG. 12 is a timing chart for comparison between the referential prior art described earlier and the present embodiment. More specifically, FIG. 12(A) is a timing chart for describing an operation of the referential prior art, whereas FIG. 12(B) is a timing chart for describing an operation in the preliminary charging according to the present embodiment. For the sake of drawing convenience, FIG. 12(A) and FIG. 12(B) do not show waveform deterioration at the gate node VG. Since FIG. 12(A) is the same as FIG. 4(A) described earlier, the operation of the referential prior art will not be repeated here. Note, however, that Time Points t1, t2, t3 in FIG. 4(A) corresponds to Time Points t2, t3, t4 in FIG. 12(A).

In the present embodiment, as shown in FIG. 12(B), the first preliminary charging and the second preliminary charging take place respectively in the selection period of the (i−2)th row and the selection period of the (i−1)th row. As described earlier, in images in general (e.g., natural images), mutually adjacent pixels are alike, so two pixel circuits 11 adjacent to each other in the column direction have similar data voltages to each other as the voltages to be supplied to their relevant capacitors C1. In other words, specifically, a data voltage Vdatai−1 in the (i−1)th row and a data voltage Vdatai in the i-th row are similar to each other. Likewise, data voltages Vdatai−2 and Vdatai−1 in the (i−2)th row and the (i−1)th row are also similar to each other. Therefore, as the preliminary charging takes place in the selection period of the (i−2)th row, the potential at the gate node VG is brought closer to Vdatai−1. Specifically, the potential at the gate node VG attains the Vdatai−2 or attains a level close to the Vdatai−2. Hereinafter, description of the present embodiment will assume that the potential at the gate node VG attains the Vdatai−2 in the selection period of the (i−2)th row.

Thereafter, the preliminary charging performed in the selection period of the (i−1)th row brings the potential at the gate node VG to a level close to the target level (Vdatai) which must be achieved in the selection period of the i-th row. Specifically, the potential at the gate node VG attains the Vdatai−1 or attains a level close to the Vdatai−1. According to the present embodiment, because of the preliminary charging which is performed in the selection period of the (i−2)th row as described above, it is possible in the selection period of the (i−1)th row to bring the potential at the gate node VG closer to Vdatai−1, more reliably.

In the selection period of the i-th row thereafter, the data voltage Vdatai in the i-th row is supplied to the gate node VG. Differing from the case of the referential prior art, the shift electric potential ΔV in the present embodiment is relatively small since it is a difference between the target level, i.e., Vdatai and Vdatai−1 which has a value close to Vdatai. Further, in the present embodiment, because of the preliminary charging performed also in the selection period of the (i−2)th row, the gate node VG has a guaranteed value of Vdatai−1 upon starting point (Time Point t3) of the selection period of the scanning line Si in the i-th row, unlike the first embodiment described earlier. For this reason, the shift electric potential ΔV is even smaller in the present embodiment than in the first embodiment. Hence, the charging time T given by Mathematical Expression (3) is even shorter than in the first embodiment and therefore, the potential at the gate node VG easily reaches the target level even in cases where the transistor T2 has a low mobility or in cases where a sufficient amount of time is not available for the selection period of the i-th row.

Figure 13:
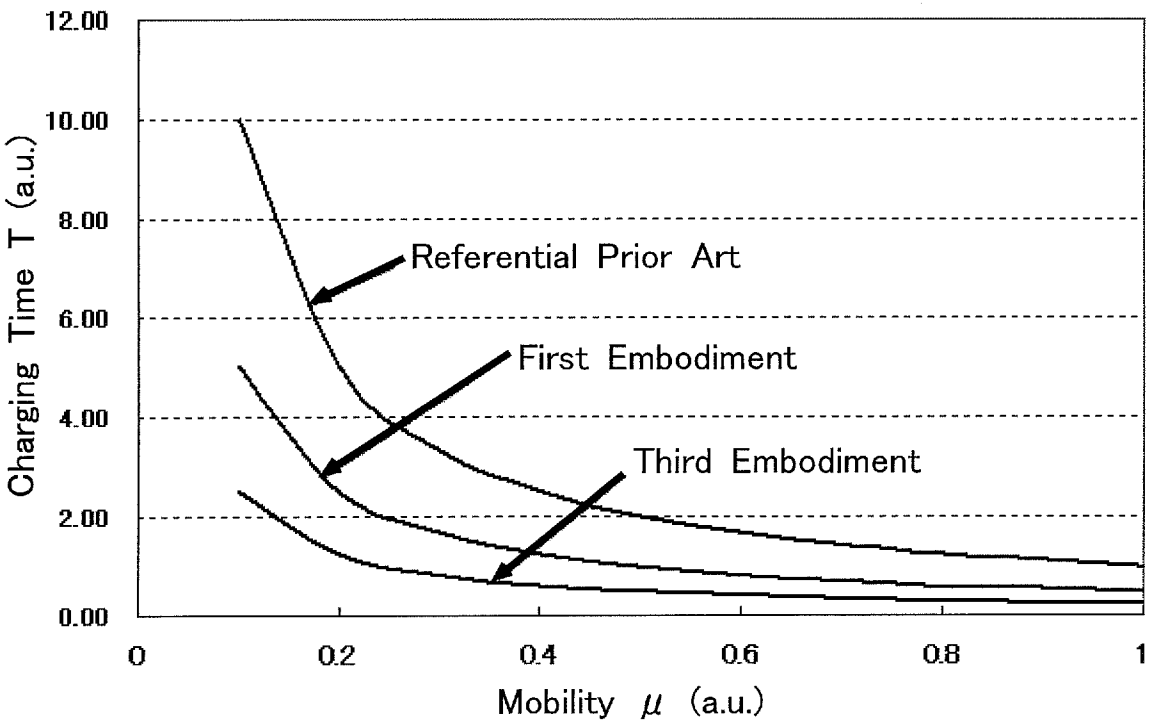
FIG. 13 shows a result of a comparative simulation of the referential prior art, the first embodiment and the third embodiment.

FIG. 13 shows a result of a comparative simulation of the referential prior art, the first embodiment and the present embodiment. As shown in FIG. 13, in the present embodiment where the first preliminary charging and the second preliminary charging are performed respectively in the first preliminary charging period and the second preliminary charging period, the charging time T is shorter (approximately 25%) than in the referential prior art. The charging time T is also shorten (approximately 50%) than the first embodiment where the preliminary charging is performed only once.

3.4 Advantages

Using the transistors T6, T3, a preliminary charging is performed in each of the first and the second preliminary charging periods. Therefore, the gate-source voltage Vgs, or the charge in the capacitor C1, becomes even closer to the desired value. This makes it possible to further improve the level of display quality. In the present embodiment, description was made for a case where k=2. However, even in cases where k equals 3 or a greater number, it is possible to obtain the same or similar advantages to those as offered by the present embodiment.

4. Fourth Embodiment

Figure 14:
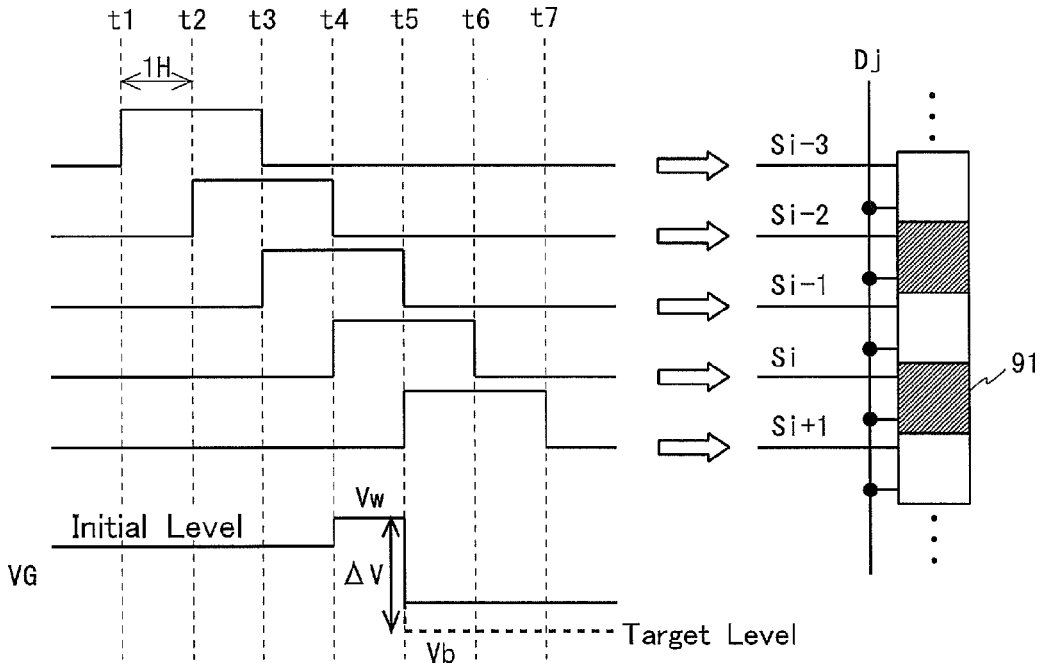
FIG. 14 is a chart for describing an operation in a case where the referential prior art is arranged to perform a preliminary charging.

Before covering a fourth embodiment of the present invention, description will be made for a case of the referential prior art, in which each scanning line has 2 H-periods as a selection period, of which 1 H-period overlaps another between two sequentially adjacent scanning lines, for performing a preliminary charging (hereinafter this configuration will be called "the referential prior art with preliminary charging function"). FIG. 14 is a figure for describing an operation of the referential prior art with preliminary charging function. FIG. 14 includes a waveform at the gate node VG, which represents the potential at the gate node VG of the pixel circuit 11 in the i-th row, j-th column. For the sake of drawing convenience, the Figure does not show waveform deterioration at the gate node VG. In FIG. 14, a period from Time Point t1 through t3 is a selection period of the (i−3)th row; A period from Time Point t2 through t4 is a selection period of the (i−2)th row; A period from Time Point t3 through t5 is a selection period of the (i−1)th row; A period from Time Point t4 through t6 is a selection period of the i-th row; and a period from Time Point t5 through t7 is a selection period of the (i+1)th row. Of the selection period for each row, a 1 H-period in the first half is a preliminary charging period, whereas the other 1 H-period in the last half is a main charging period.

As an example, a pattern display will be considered, of a stripe pattern consisting of white and black lines alternating with each other for every row. In FIG. 14, each of the data voltages in the (i−3)th row, (i−1)th row, and (i+1)th row has a data voltage representing a brightness (maximum brightness) for displaying the color of white (hereinafter called "white data voltage" and will be indicated with a reference symbol Vw), whereas each of the data voltages in the (i−2)th row and the i-th row has a data voltage representing a brightness (minimum brightness) for displaying the color of black (hereinafter called "black data voltage" and will be indicated with a reference symbol Vb).

Before Time Point t4, the gate node VG maintains an initial level. From Time Point t4 through t5, i.e., in the preliminary charging period for the i-th row, a white data voltage Vw in the (i−1)th row is supplied to the gate node VG via the transistor T2, so the potential at the gate node VG changes in accordance with the white data voltage Vw. Specifically, the potential at the gate node VG attains the Vw or attains a level close to the Vw. From Time Point t5 through t6, i.e., in the main charging period for the i-th row, a black data Vb in the i-th row is supplied to the gate node VG via the transistor T2, so the potential at the gate node VG changes in accordance with the black data Vb. In this process, the shift electric potential ΔV is a difference between the maximum data voltage, i.e., the white data voltage Vw, and the minimum data voltage, i.e., the black data voltage Vb or a value close to Vb, and therefore a long charging time T is necessary according to Mathematical Expression (3). This makes it difficult for the potential at the gate node VG to attain the target level. As understood from the above, when displaying the stripe pattern consisting of white and black lines alternating with each other for every row in the referential prior art with preliminary charging function, the potential at the gate node VG changes in the reverse direction from the direction in which the potential at the gate node VG should move to attain the target level within the preliminary charging period. This means that the preliminary charging does not provide advantages.

4.1 Pixel Circuit and Operation

Figure 15:
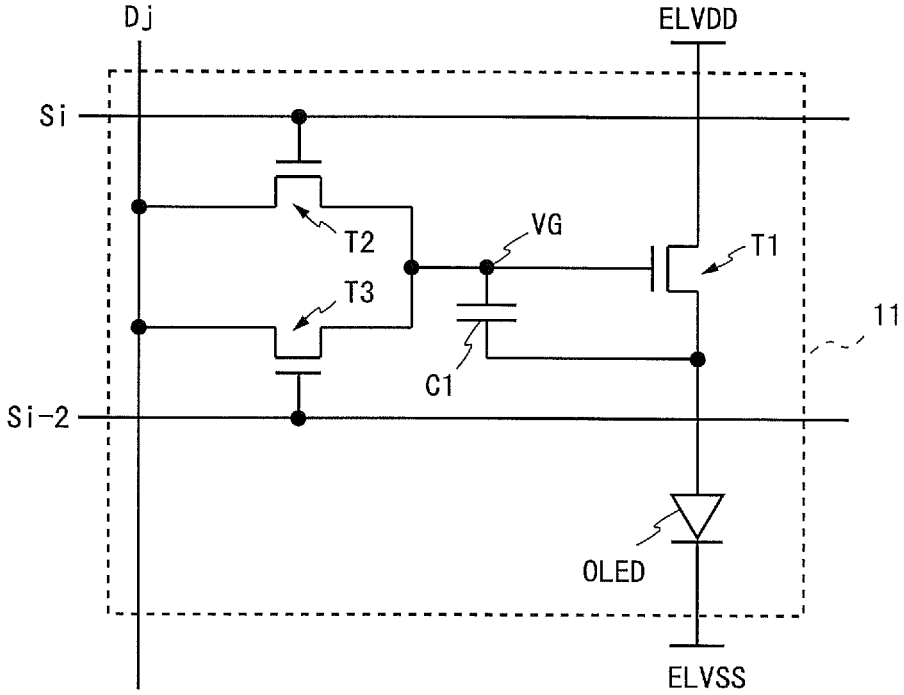
FIG. 15 is a circuit diagram showing a configuration of a pixel circuit according to a fourth embodiment of the present invention.

FIG. 15 is a circuit diagram showing a configuration of a pixel circuit 11 in the i-th row, j-th column according to the fourth embodiment of the present invention. The pixel circuit 11 according to the present embodiment has the same configuration as the pixel circuit 11 in FIG. 2, except that the transistor T3 has its gate terminal not connected to the scanning line Si−1 in the (i−1)th row but to the scanning line Si−2 in the (i−2)th row.

Figure 16:
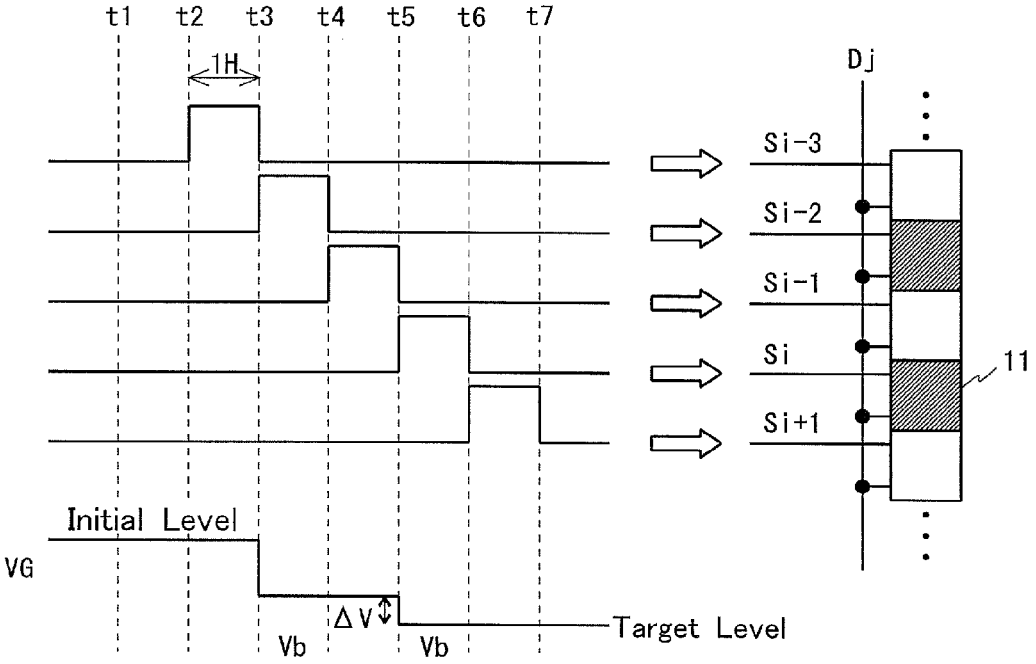
FIG. 16 is a chart for describing an operation of the pixel circuit in FIG. 15.
Figure 17:
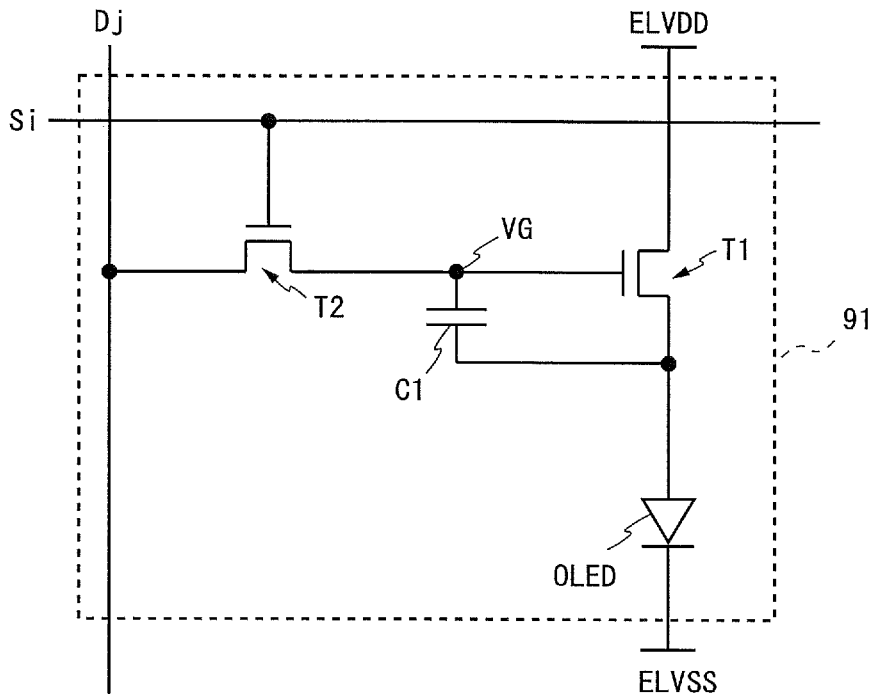
FIG. 17 is a circuit diagram showing a configuration of a pixel circuit according to the referential prior art.
Figure 18:
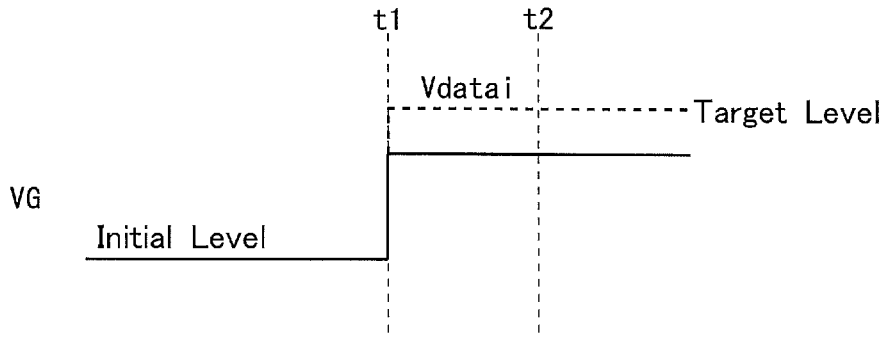
FIG. 18 is a timing chart for describing an operation of the pixel circuit in FIG. 17.

FIG. 16 is a chart for describing an operation of the pixel circuit 11 in FIG. 15. In FIG. 16, a period from Time Point t1 through t2 is a preliminary charging period for the (i−2)th row; A period from Time Point t2 through t3 is a main charging period for the (i−3)th row and a preliminary charging period for the (i−1)th row. A period from Time Point t3 through t4 is a main charging period for the (i−2)th row and a preliminary charging period for the i-th row. A period from Time Point t4 through t5 is a main charging period for the (i−1)th row and a preliminary charging period for the (i+1)th row. A period from Time Point t5 through t6 is a main charging period for the i-th row. A period from Time Point t6 through t7 is a main charging period for the (i+1)th row. As an example, the same pattern display, as in FIG. 14, of a stripe pattern consisting of white and black lines alternating with each other for every row will be used.

Before Time Point t3, the gate node VG maintains an initial level. From Time Point t3 through t4, i.e., the preliminary charging period for the i-th row, a black data voltage Vb in the (i−2)th row is supplied to the gate node VG via the transistor T3, so the potential at the gate node VG changes in accordance with the black data voltage Vb. Specifically, the potential at the gate node VG attains the Vb or attains a level close to the Vb. From Time Point t4 through t5, the transistors T2, T3 are in OFF state, so the potential at the gate node VG does not change. From Time Point t5 through t6, i.e., in the main charging period for the i-th row, a black data Vb in the i-th row is supplied to the gate node VG via the transistor T2, so the potential at the gate node VG changes in accordance with the black data Vb. In this situation, the shift electric potential ΔV is a difference between the black data voltage Vb or a level close to Vb, and the black data voltage Vb. In other words, the shift electric potential ΔV is extremely small in value. Therefore, the charging time T given by Mathematical Expression (3) is sufficiently shorter than in the referential prior art with preliminary charging function.

4.2 Advantages

According to the present embodiment, use of the transistor T3 which has its gate terminal to the scanning line Si−2 in the (i−2)th row makes it possible to sufficiently shorten the charging time T even when performing a display where the referential prior art with preliminary charging function cannot enjoy any advantages provided by the preliminary charging. Use of the transistor T3 also provides an advantage, namely, the preliminary charging can be performed with a general operation design that n scanning lines S1 through Sn are selected sequentially, without requiring a special operation arrangement of the scanning driver 40 such as 1 H-period overlap between two sequentially adjacent scanning lines. It should be noted here that advantages similar to those provided by the present embodiment can be obtained not only when displaying the stripe pattern consisting of white and black lines alternating with each other for every row, but in other cases when displaying an image having a cyclic pattern change in the column direction, by appropriately selecting the scanning line to which the gate terminal of the transistor T3 is connected.

5. Others

The present invention is not limited to the embodiments described thus far, but may be varied in many ways within the spirit of the present invention. For example, although the gate terminal of the transistor T3 is connected to the immediately preceding scanning line in the first and the second embodiments, the connection may be made to any one of the preceding scanning lines.

In the third embodiment, the gate terminal of the transistor T3 is connected also to the immediately preceding scanning line, but again, the connection may be made to any one of the preceding scanning lines. In this case, however, the scanning line to which the gate terminal of the transistor T3 is connected must not be the scanning line to which the transistor T6 is connected via its gate terminal.

In the variation of the second embodiment, only the transistor T4 is used out of the two transistors T4 and T5. However, only the transistor T5 may be used out of the two transistors T4 and T5.

In the third embodiment, two or more of the transistor T6 may be utilized, with their respective gate terminals connected to different scanning lines from each other. In this case, however, the scanning line to which the gate terminal of the transistor T3 is connected must not be any of the scanning lines to which any one of the transistors T6 is connected via its gate terminal.

In each of the embodiments described thus far, n-channel transistors are used as the transistors inside the pixel circuit 11. However, p-channel transistors may be used instead.

Also, in each of the embodiments, there may be an arrangement for compensating variations in a threshold voltage of the transistor T1.

INDUSTRIAL APPLICABILITY

The present invention is applicable to a pixel circuit which includes an electro-optic element such as an organic EL (Electro Luminescence) element; to a display devices including the same; and to a method of driving the display device.

LEGENDS

1 Organic EL Display Device
10 Display Section
11 Pixel Circuit
20 Display Control Circuit
30 Source Driver (Data Driving Section)
40 Scanning Driver (Scanning Driving Section)
D1 through Dm Data Line
S1 through Sn Scanning Lines
Em1 through Emn Emission Line
T1 through T6 Transistor
C1 Capacitor (Drive Capacitance Element)
Oled Organic El Element (Electro-Optic Element)
Vdata Data Voltage
Vg Gate Node

The invention claimed is:

1. A pixel circuit disposed in an active matrix display device, correspondingly to one of data lines and to one of scanning lines which are to be selected sequentially, the circuit comprising:

an electro-optic element configured to be driven by an electric current;

a drive transistor which is disposed in series with the electro-optic element and configured to control a drive current to be supplied to the electro-optic element;

a drive capacitance element configured to hold a voltage for controlling the drive transistor;

a first input transistor which has its control terminal connected to a corresponding one of the scanning lines, its first conduction terminal connected to a corresponding one of the data lines, and its second conduction terminal connected to one terminal of the drive capacitance element as well as to a control terminal of the drive transistor; and a second input transistor which has its control terminal connected to a scanning line preceding said corresponding scanning line, the scanning line preceding said corresponding scanning line being immediately before said corresponding scanning line in terms of selection sequence of the scanning lines in the active matrix display device and being a scanning line which corresponds to an adjacent pixel circuit, its first conduction terminal connected to said corresponding one of the data lines, and its second conduction terminal electrically and directly connected to said one terminal of the drive capacitance element as well as to the control terminal of the drive transistor.

2. The pixel circuit according to claim 1, further comprising a third input transistor which has its control terminal connected to one of the scanning lines preceding said corresponding scanning line not connected to the control terminal of the second input transistor, and is disposed between said corresponding data line and the drive capacitance element.

3. An active matrix display device comprising:

the pixel circuit according to claim 2; and a scanning driving section configured to make sequential selection of the scanning lines.

4. The pixel circuit according to claim 1, further comprising an emission control transistor which is in series with the electro-optic element, and is configured to assume an OFF state when the scanning line which is connected to one of the control terminal of the first input transistor and the control terminal of the second input transistor is in a selected state.

5. An active matrix display device comprising:

the pixel circuit according to claim 4; and a scanning driving section configured to make sequential selection of the scanning lines.

6. The pixel circuit according to claim 4, wherein the emission control transistor transitions to an OFF state when the scanning line connected to the control terminal of the first input transistor is in a selected state and when the scanning line connected to the control terminal of the second input transistor is in a selected state.

7. The pixel circuit according to claim 1, wherein the first input transistor is a thin-film transistor having its channel layer formed of an oxide semiconductor, a microcrystalline silicon or an amorphous silicon.

8. An active matrix display device comprising:

the pixel circuit according to claim 7; and a scanning driving section configured to make sequential selection of the scanning lines.

9. An active matrix display device comprising:

the pixel circuit according to claim 1; and a scanning driving section configured to make sequential selection of the scanning lines.

10. An active matrix display device comprising:

the pixel circuit according to claim 1; and a scanning driving section configured to make sequential selection of the scanning lines.

11. The pixel circuit according to claim 1, wherein the drive capacitance element has another terminal connected to a node between the drive transistor and the electro-optic element.

12. The pixel circuit according to claim 1, wherein the drive capacitance element is configured to be charged to a first voltage during a preliminary charging period via the corresponding data line and the second input transistor when the scanning line connected to the control terminal of the second input transistor is in a selected state, and the drive capacitance element is configured to be charged to a second voltage during a main charging period via the corresponding data line and the first input transistor when the scanning line connected to the control terminal of the first input transistor is in a selected state.

13. The pixel circuit according to claim 12, wherein the voltage supplied to the drive capacitance element during the preliminary charging period is a voltage corresponding to a voltage to be supplied to a drive capacitance element in the adjacent pixel circuit during the main charging period.

14. The pixel circuit according to claim 12, wherein a period during which the emission control transistor transitions to an OFF state overlaps with a period during which an emission control transistor in the adjacent pixel circuit transitions to an OFF state, for one horizontal period.

15. A driving method of active matrix display device including a display section which has: a plurality of data lines; a plurality of scanning lines and a plurality of pixel circuits disposed correspondingly to the plurality of data lines and the plurality of scanning lines; the pixel circuit including: an electro-optic element driven by an electric current; a drive transistor which is disposed in series with the electro-optic element and controls a drive current to be supplied to the electro-optic element; a first input transistor and a second input transistor disposed such that a first conduction terminal of the first input transistor and a first conduction terminal of the second input transistor are connected to one of the data lines which corresponds to the pixel circuit; a second conduction terminal of the first input transistor is connected to the control terminal of the drive transistor; a second conduction terminal of the second input transistor is electrically and directly connected to the control terminal of the drive transistor and a drive capacitance element which holds a voltage for controlling the drive transistor;

the method comprising:

sequentially selecting the scanning lines;

electrically connecting the one of the data lines which corresponds to the pixel circuit to one terminal of the drive capacitance element as well as to the control terminal of the drive transistor in the pixel circuit, upon selection of one of the scanning lines which corresponds to the pixel circuit; and electrically connecting one of the data lines which corresponds to the pixel circuit to said one terminal of the drive capacitance element as well as to the control terminal of the drive transistor in the pixel circuit, upon selection of one of the scanning lines which precedes the scanning line that corresponds to the pixel circuit, wherein the scanning line which precedes said scanning line that corresponds to the pixel circuit is immediately before said corresponding scanning line in terms of selection sequence of the scanning lines in the active matrix display device and is a scanning line which corresponds to an adjacent pixel circuit.

16. The driving method according to claim 15, wherein the drive capacitance element is supplied with a voltage at said one terminal via said one of the data lines, when one of the scanning lines which precedes the scanning line that corresponds to the pixel circuit is selected as well as when the scanning line that corresponds to the pixel circuit is selected.

* * * * *